US012636589B1

(12) United States Patent
Yang et al.

(10) Patent No.: US 12,636,589 B1
(45) Date of Patent: May 26, 2026

(54) FOG COLLECTING BOX AND BUBBLE MACHINE

(71) Applicant: SHENZHEN QIAOHUA INDUSTRIES LIMITED., Shenzhen (CN)

(72) Inventors: Ruimian Yang, Shenzhen (CN); Ruibao Chen, Shenzhen (CN); Jun Cao, Shenzhen (CN); Xianhua Liu, Shenzhen (CN)

(73) Assignee: SHENZHEN QIAOHUA INDUSTRIES LIMITED., Shenzhen (CN)

( * ) Notice: Subject to any disclaimer, the term of this patent is extended or adjusted under 35 U.S.C. 154(b) by 0 days.

(21) Appl. No.: 19/090,632

(22) Filed: Mar. 26, 2025

(30) Foreign Application Priority Data

Jan. 17, 2025 (CN) ..... 202520122190.8
Feb. 24, 2025 (CN) ..... 202520299555.4

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS 11,173,415 B1 * 11/2021 Yang ..... A63H 33/28
2004/0259458 A1 * 12/2004 Fusco ..... A63H 33/28
446/15
2005/0148276 A1 * 7/2005 LaFata ..... A63H 33/26
446/18
2006/0116048 A1 * 6/2006 Choi ..... A63H 33/28
446/15
2009/0017713 A1 * 1/2009 Chung ..... A63H 33/28
446/15
2018/0345164 A1 * 12/2018 Venigalla ..... A63H 33/28
2019/0126161 A1 * 5/2019 Yang ..... A63J 5/02
2020/0398177 A1 * 12/2020 Peeples ..... A63H 33/28
2022/0088499 A1 * 3/2022 Pogue ..... A63J 5/025
2023/0135754 A1 * 5/2023 Yang ..... A63H 33/28
446/15
2023/0277953 A1 * 9/2023 Kelly ..... A63H 33/22
446/15
2024/0316475 A1 * 9/2024 Peeples ..... A63J 5/025

FOREIGN PATENT DOCUMENTS

CN 211215438 U * 8/2020
KR 20210148786 A * 12/2021 ..... A63H 29/22

OTHER PUBLICATIONS

Translation KR20210148786A (Year: 2021).*
Translation CN211215438U (Year: 2020).*

* cited by examiner

*Primary Examiner* — Eugene L Kim
*Assistant Examiner* — Alyssa M Hylinski
(74) *Attorney, Agent, or Firm* — HOWARD M COHN and Associates, LLC

(57) ABSTRACT

A fog collecting box and a bubble machine are provided. The fog collecting box is mounted in the bubble machine. The fog collecting box includes an inlet, an outlet, and a channel defined in the fog collecting box. The channel is communicated between the inlet and the outlet of the fog collecting box. The channel includes at least one bending section, so that a length of the channel is greater than a linear distance between the inlet and the outlet of the fog collecting box.

12 Claims, 18 Drawing Sheets

FOG COLLECTING BOX AND BUBBLE MACHINE

TECHNICAL FIELD

The present disclosure relates to a field of bubble blowing technology, and in particular to a fog collecting box and a bubble machine.

BACKGROUND

A bubble machine is a machine configured to generate bubbles, which is not only used for daily entertainment, but also use for creating a certain stage atmosphere.

A conventional fog-filled bubble machine commonly includes a fog liquid pump configured to convey fog liquid, a heater, a fog collecting box, a fog bubble nozzle communicated with the fog collecting box, a bubble liquid pump, a film scraping body, and a brush rod driving mechanism. The heater is connected to the fog liquid pump through a fog liquid conveying pipe. The fog collecting box is configured to collect fog generated by the heater heating the fog liquid. The fog bubble nozzle defines a nozzle port. The bubble liquid pump is configured to convey bubble solution to the nozzle port of the fog bubble nozzle. The film scraping body is configured to scrape and brush at the nozzle port to form a bubble film. The brush rod driving mechanism is configured to reciprocate the film scraping body at the nozzle port. The fog-filled bubble machine further includes a bubble blowing fan configured to blow the bubble film.

However, part of the fog condenses in the channel of the fog bubble nozzle to form the fog liquid. The fog liquid may flows to the nozzle port, affecting a reciprocating movement of the film scraping body at the nozzle port, thereby affecting generations of subsequent bubble films.

SUMMARY

The present disclosure provides a bubble machine, which reduces or even prevents fog liquid in a bubble channel of a film forming nozzle thereof from flowing to an outlet of the film forming nozzle and affecting generations of subsequent bubble films at the outlet of the film forming nozzle.

DETAILED DESCRIPTION

Figure 1:
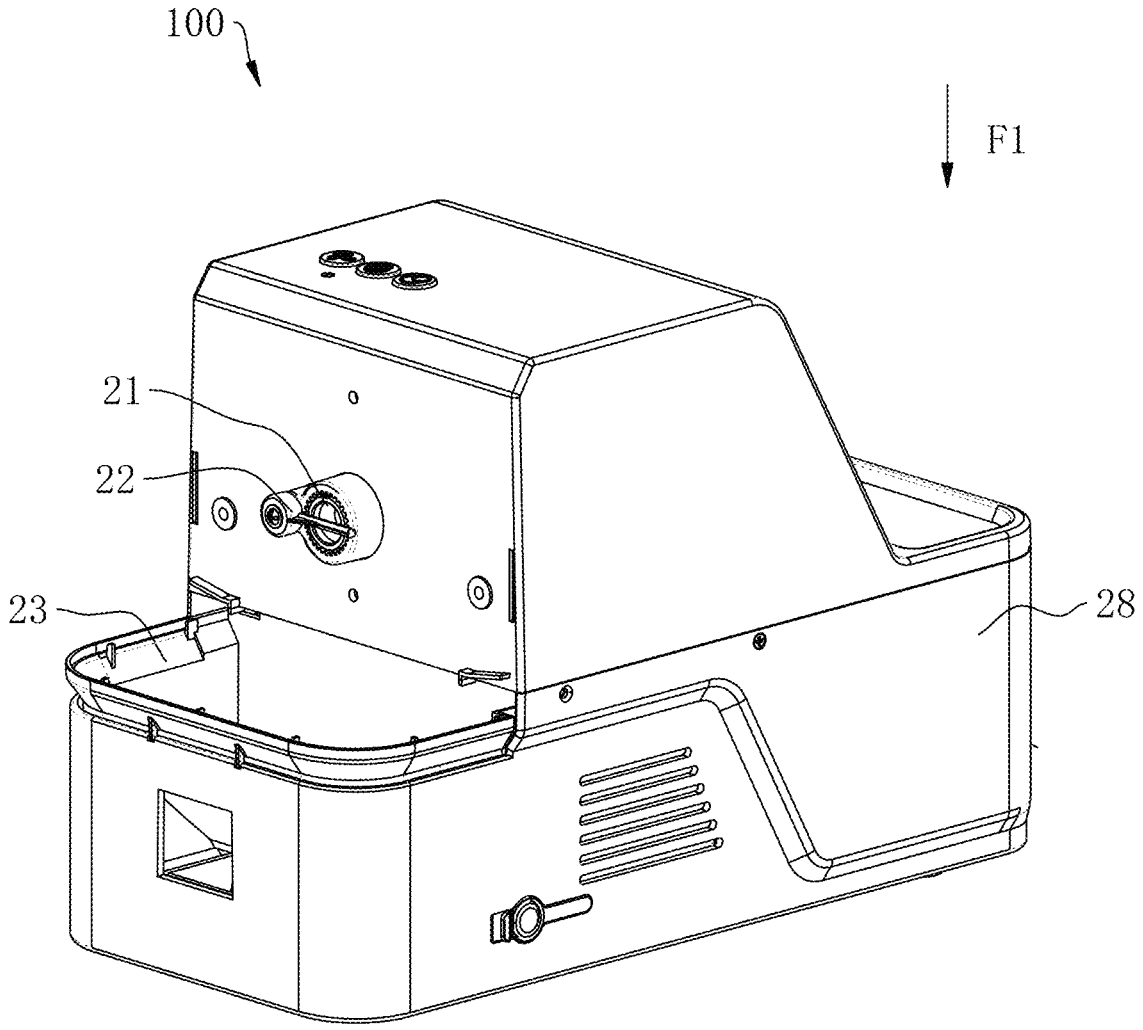
FIG. 1 is a perspective schematic diagram of a bubble machine of the present disclosure.
Figure 2:
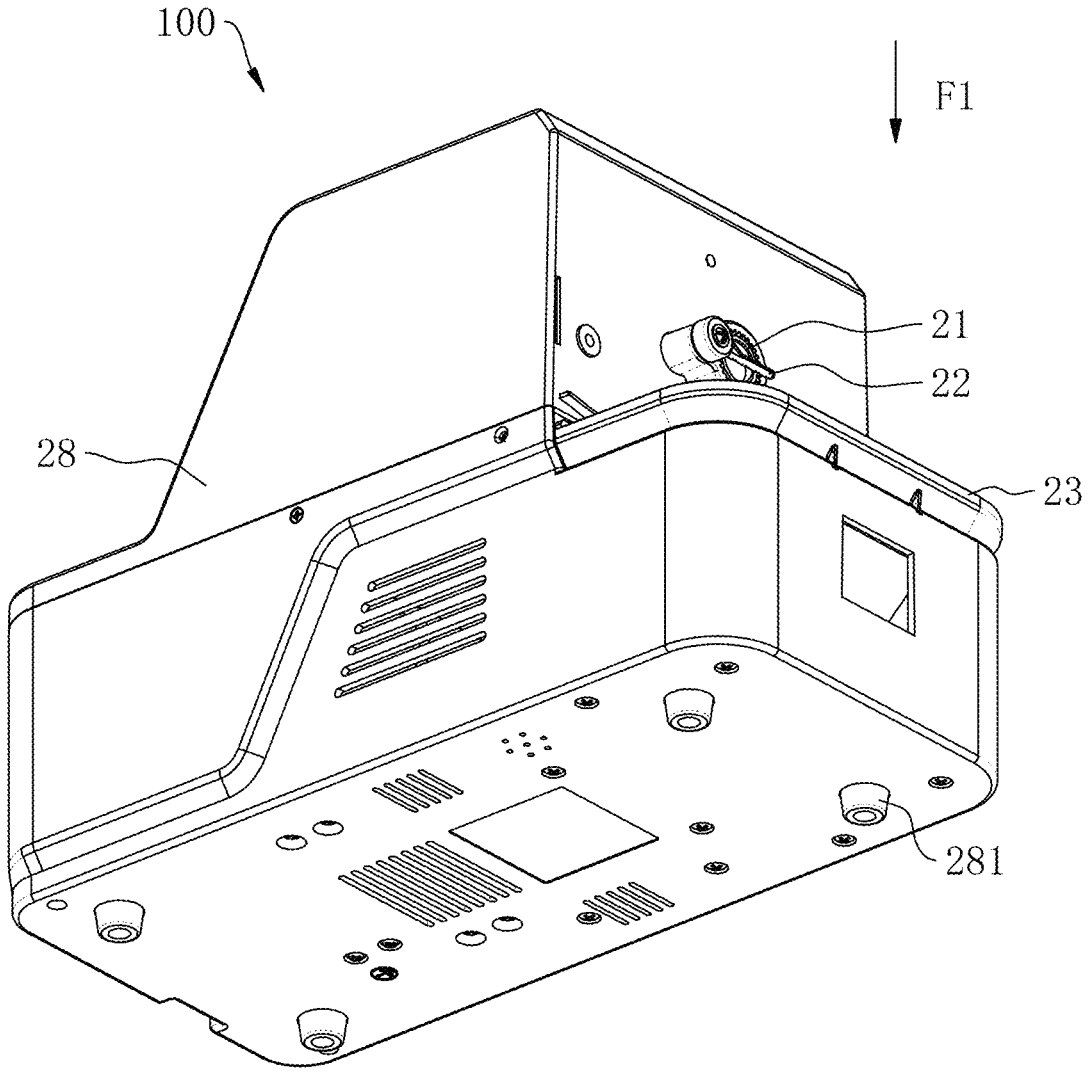
FIG. 2 is another perspective schematic diagram of the bubble machine of the present disclosure.

As shown in FIGS. 1 and 2, the present disclosure provides a bubble machine 100 that produces effects of fog and bubbles. Specifically, the bubble machines is configured to produce bubbles, fog, haze, and fog-filled bubbles. The bubble machine is used in stage performances, weddings, celebrations, and other occasions to create a certain visual effect. Specifically, bubbles blown by the bubble machine 100 are allowed to be filled with fog.

Figure 3A:
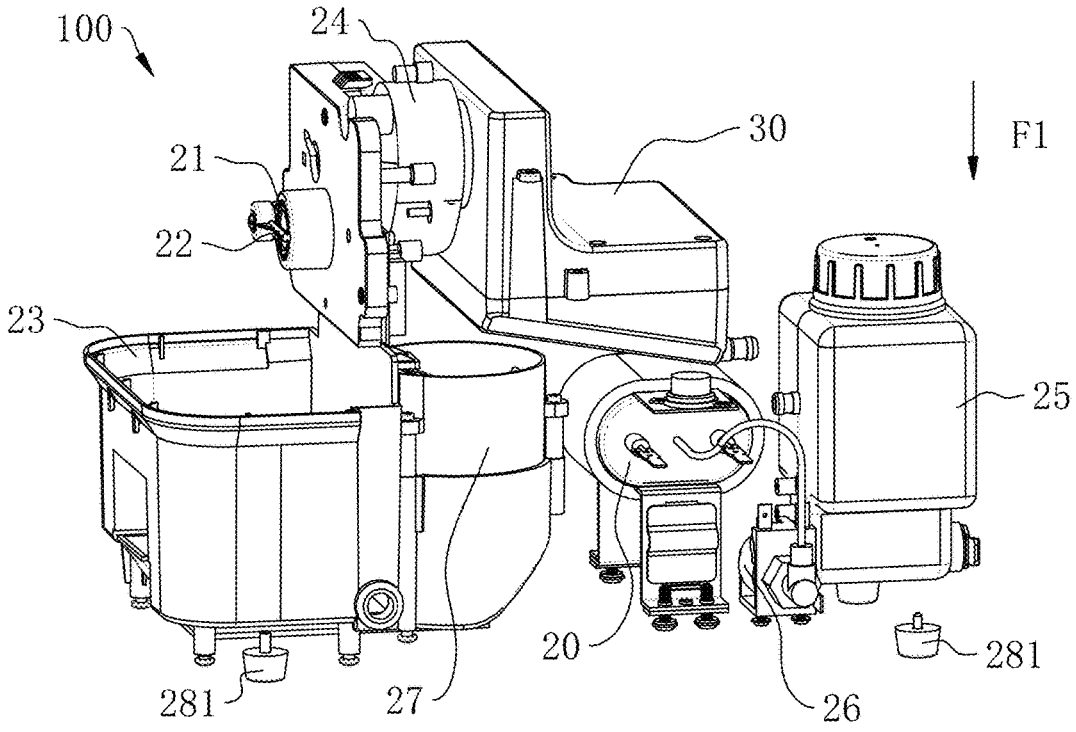
FIG. 3A is a partial schematic diagram of the bubble machine of the present disclosure.
Figure 3B:
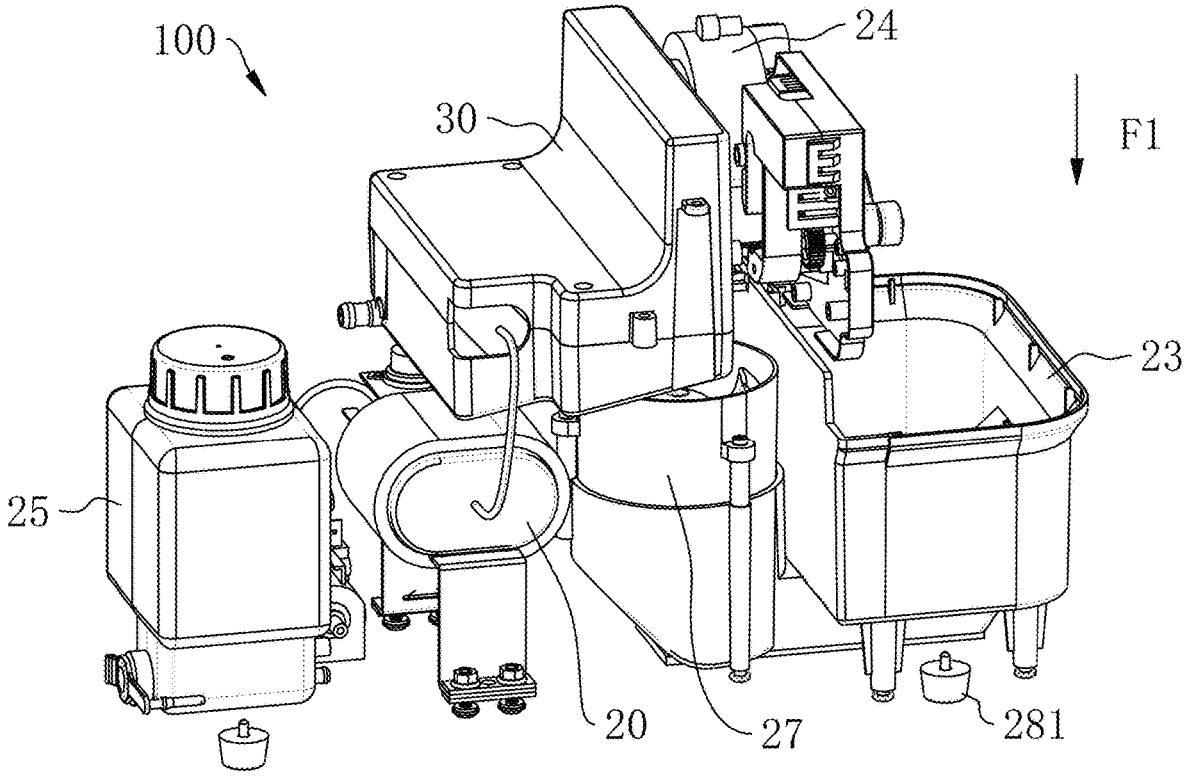
FIG. 3B is another partial schematic diagram of the bubble machine of the present disclosure.

Specifically, as shown in FIGS. 3A and 3B, the bubble machine 100 includes a heater 20 and a fog collecting box 30. The heater 20 is configured to heat fog liquid to atomize the fog liquid to generate the fog. The fog collecting box 30 is configured to collect the fog. After the fog is discharged from the fog collecting box 30, the fog reaches a position where a bubble film is formed. When the bubble film gradually forms a bubble under an air pressure difference, the fog flows into the bubble to form a fog-filled bubble.

As shown in FIG. 1, the bubble machine 100 further includes a film forming nozzle 21 and a film scraping body 22. The film scraping body 22 is movably disposed relative to the film forming nozzle 21. When the film scraping body 22 moves relative to the film forming nozzle 21, the bubble solution form the bubble film at one end of the film forming nozzle 21. Furthermore, the bubble machine 100 further includes a bubble solution reservoir 23. The bubble solution reservoir 23 is configured to store the bubble solution. Optionally, the film forming nozzle 21 and the bubble solution reservoir 23 are communicated through a liquid pipe to guide the bubble solution in the bubble solution reservoir 23 to flow to the film forming nozzle 21.

Figure 4:
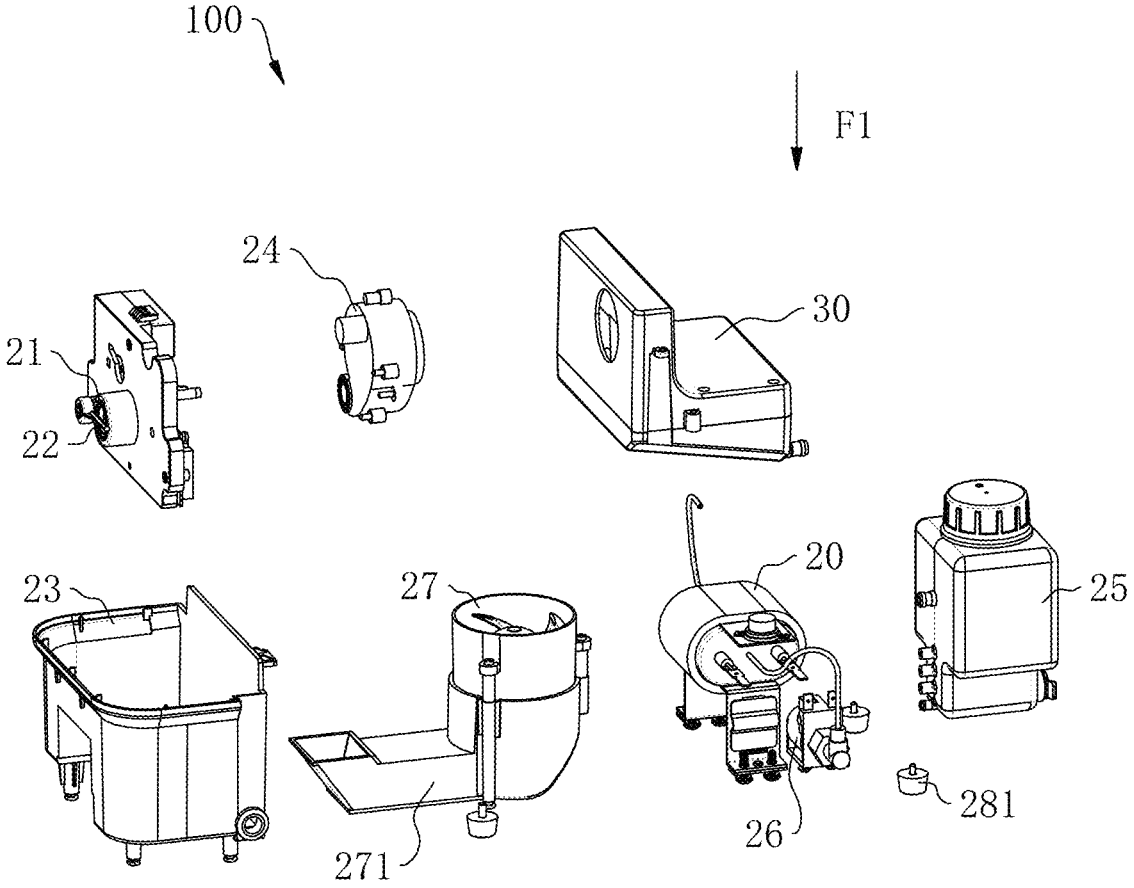
FIG. 4 is an exploded schematic diagram of the bubble machine of the present disclosure.

As shown in FIGS. 3A and 4, the bubble machine 100 further includes a first airflow driving piece 24. The first airflow driving piece 24 is configured to suck out the fog from the fog collecting box 30 and drive the fog to flow to the position where the bubble film is formed. Specifically, the first airflow driving piece 24 is a first fan. Specifically, the fog flows to the film forming nozzle 21. For instance, the first airflow driving piece 24 connects the fog collecting box 30 and the film forming nozzle 21, and the first airflow driving piece 24 communicates the fog collecting box 30 and the film forming nozzle 21 to drive the fog in the fog collecting box 30 to flow into a bubble channel of the film forming nozzle 21.

Figure 5:
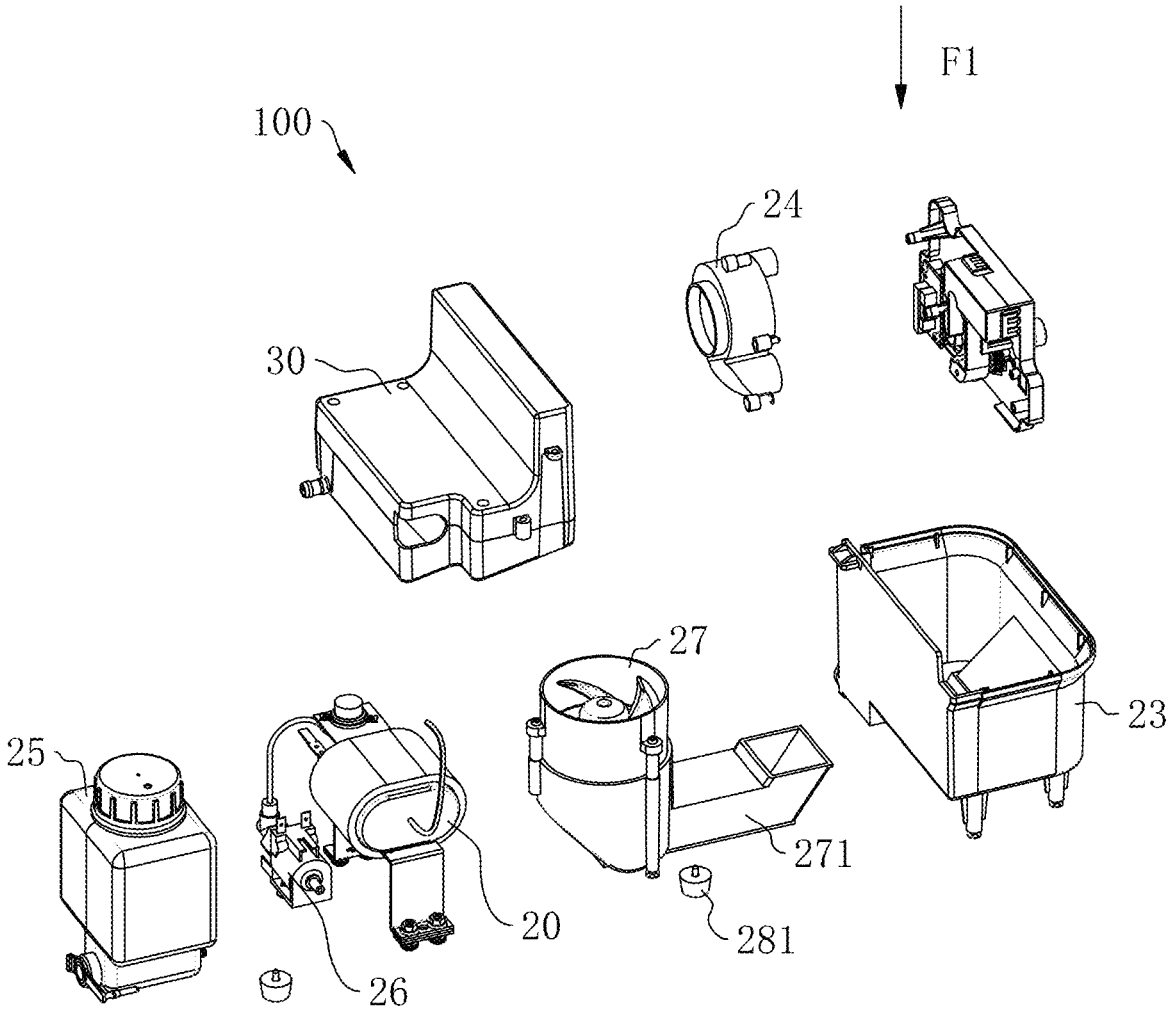
FIG. 5 is another exploded schematic diagram of the bubble machine of the present disclosure.

As shown in FIGS. 3A and 5, the bubble machine 100 further includes a fog liquid reservoir 25 configured to store the fog liquid. The fog liquid in the fog liquid reservoir 25 is discharged to the heater 20 for heating. In some embodiments, the bubble machine 100 further includes a fog liquid pump 26 configured to pump the fog liquid from the fog liquid reservoir 25 to the heater 20. Furthermore, the fog liquid pump 26 having a guide pipe is connected between the fog liquid reservoir 25 and the heater 20. In other embodiments, by limiting a height relationship between the fog liquid reservoir 25 and the heater 20, the fog liquid in the fog liquid reservoir 25 is able to flow to the heater 20 under gravity.

As shown in FIGS. 3B and 4, the bubble machine 100 further includes a second airflow driving piece 27 configured to form an airflow. The airflow is configured to blow generated fog-filled bubbles to a position away from the bubble machine 100 to prevent the generated fog-filled bubbles from accumulating and colliding near the bubble machine 100. In some embodiments, the second airflow driving piece 27 is a second fan. The bubble machine 100 further includes an airflow guide piece 271 connected to the second airflow driving piece 27. The airflow guide piece 271 is configured to adjust a flow direction of the airflow generated by the second airflow driving piece 27.

As shown in FIG. 2, the bubble machine 100 includes a housing 28. The heater 20, the fog collecting box 30. The film forming nozzle 21, the fog liquid reservoir 25, the first airflow driving piece 24, and the second airflow driving piece 27 are completely or partially mounted in the housing 28.

As shown in FIG. 2, in some embodiments, the bubble machine 100 defines a first reference direction F1. When the bubble machine 100 is in use, and the bubble machine 100 is placed on a supporting surface in a normal use state, the first reference direction F1 is substantially perpendicular to the supporting surface. Optionally, the housing 28 includes a bottom side, and support feet 281 are disposed on the bottom side of the housing 28. In the normal use state, the support feet support the housing 28.

Figure 6:
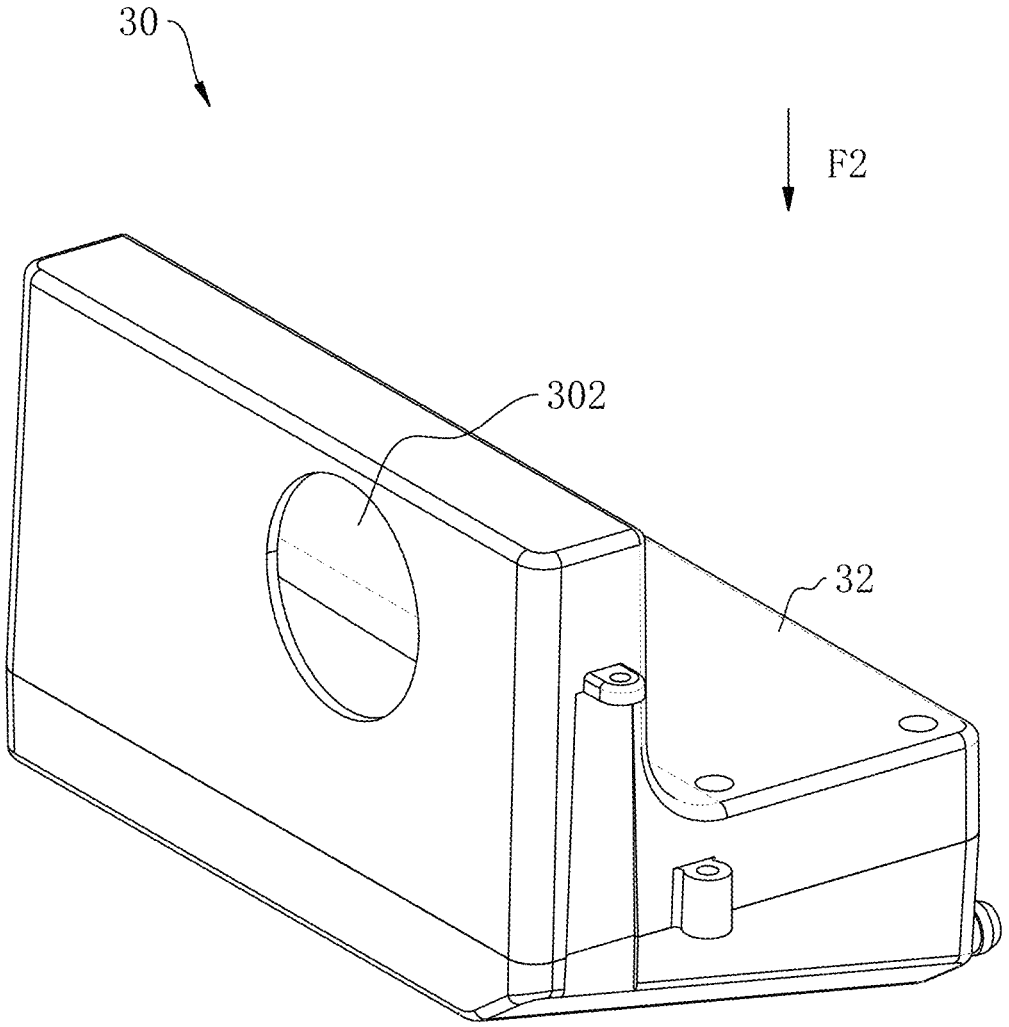
FIG. 6 is a perspective schematic diagram of a fog collecting box of the bubble machine of the present disclosure.

As shown in FIGS. 3A and 6, the fog collecting box 30 has a predetermined mounting state relative to the housing 28 or other support structures. In the predetermined mounting state, the first reference direction F1 of the bubble machine 100 is substantially the same as a vertical downward direction, and the fog collecting box 30 has a certain direction relative to the housing 28 or other support structures, so that various components of the fog collecting box 30 have a certain height relationship therebetween. Furthermore, the fog collecting box 30 defines a second reference direction F2. The second reference direction F2 is substantially the same as the first reference direction F1.

As shown in FIGS. 6-9, the present disclosure further provides the fog collecting box 30, which is applied to the bubble machine 100 mentioned above. The fog collecting box 30 defines an inlet 301 and an outlet 302. A channel 31 is defined inside the fog collecting box 30, and the channel 31 is communicated between the inlet 301 and the outlet 302. The channel 31 includes at least one bending section 311, so that a length of the channel 31 is greater than a linear distance between the inlet 301 and the outlet 302.

When the fog collecting box 30 of the present disclosure is used, the fog generated by the atomization of the fog liquid enters the fog collecting box 30 from the inlet 301. Then, the fog flows along the channel 31 until the fog reaches the outlet 302. After the fog flows out of the fog collecting box 30 from the outlet 302, the fog is blown together with the bubble film to generate the fog-filled bubble. Under a premise that a volume of the fog collecting box 30 is fixed, since the channel 31 includes the at least one bending section 311, the at least one bending section 31 prevents the fog at the inlet 301 from linearly flowing to the outlet 302, thereby increasing a length of the channel 31. Since the length of the channel 31 increases, a time for the fog to flow in the channel 31 is extended and more fog particles are adhered to an inner wall of the fog collecting box 30, so that content of the fog particles in the fog ta the outlet 302 is reduced, and there is no need to set a porous filtering structure close to the outlet 302 to avoid blockage of the porous filtering structure caused by the fog particles. Therefore, the fog collecting box 30 has a stable fog output efficiency.

It is understood that the length of the channel 31 is increased and the time for the fog to flow in the channel 31 is extended, so a temperature of the fog is reduced accordingly. Specifically, the temperature of the fog discharged from the outlet 302 of the fog collecting box 30 is reduced to a suitable temperature, thereby avoiding damage to other components of the bubble machine 100 due to excessive temperature of the fog. Therefore, the generation of the bubbles is not affected due to excessive temperature of the fog.

It is understood that the channel 31 is formed inside the fog collecting box 30 and the channel 31 includes at least one bending section 311. Compared with the fog collecting box 30 having a cavity between the inlet 301 and the outlet 302, in the fog collecting box 30 of the present disclosure, the fog flows to the outlet 302 in an orderly manner after entering the channel 31, avoiding the fog with high temperature and the fog with a suitable temperature from being discharged from the outlet 302 in an disorderly alternating manner, which is conducive to ensuring temperature uniformity of the discharged fog.

Figure 7:
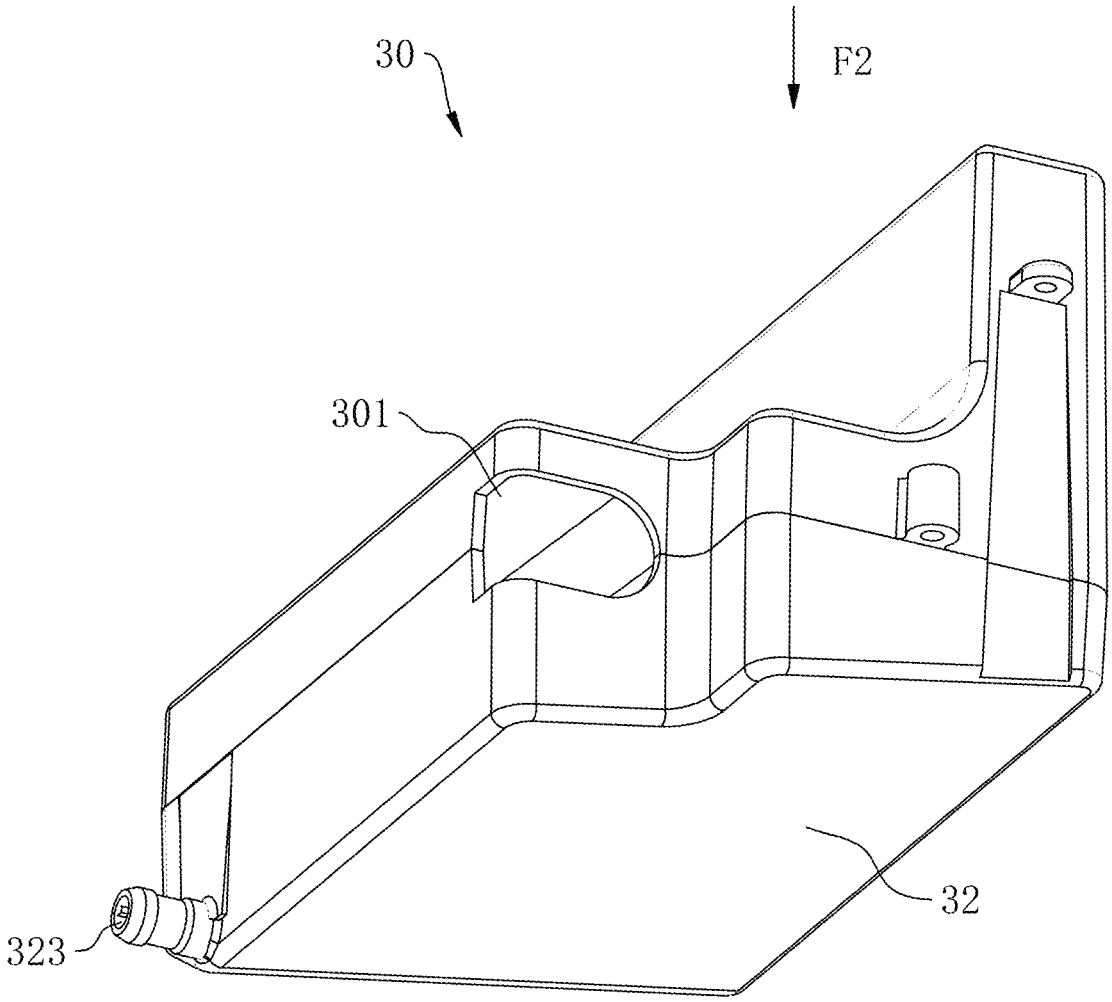
FIG. 7 is another perspective schematic diagram of a fog collecting box of the bubble machine of the present disclosure.

Optionally, as shown in FIGS. 6 and 7, in the predetermined mounting state, a height of the inlet 301 is lower than a height of the outlet 302. On the one hand, the fog liquid gathered on a boundary surface of the channel 31 is allowed to flow to a vicinity of the inlet 301 under the gravity, which is conducive to recycling of the fog liquid. On the other hand, since the outlet 302 is relatively high relative to the inlet 301, the gathered fog liquid is prevented from blocking the outlet 302, thereby ensuring the fog output efficiency of the fog collecting box 30. It is understood that along the second reference direction F2, the inlet 301 is below the outlet 302.

In a predetermined mounting state, the height of the inlet 301 is close to or the same as the height of the outlet 302.

The at least one bending section 311 is in an arc shape, a polyline shape, or a spiral shape. It is understood that a flow direction of the fog changes after passing through the at least one bending section 311. Optionally, the channel 31 includes bending sections 311 communicated in sequence. Each two bending sections 311 that are communicated may have the same shape or different shapes.

Figure 8:
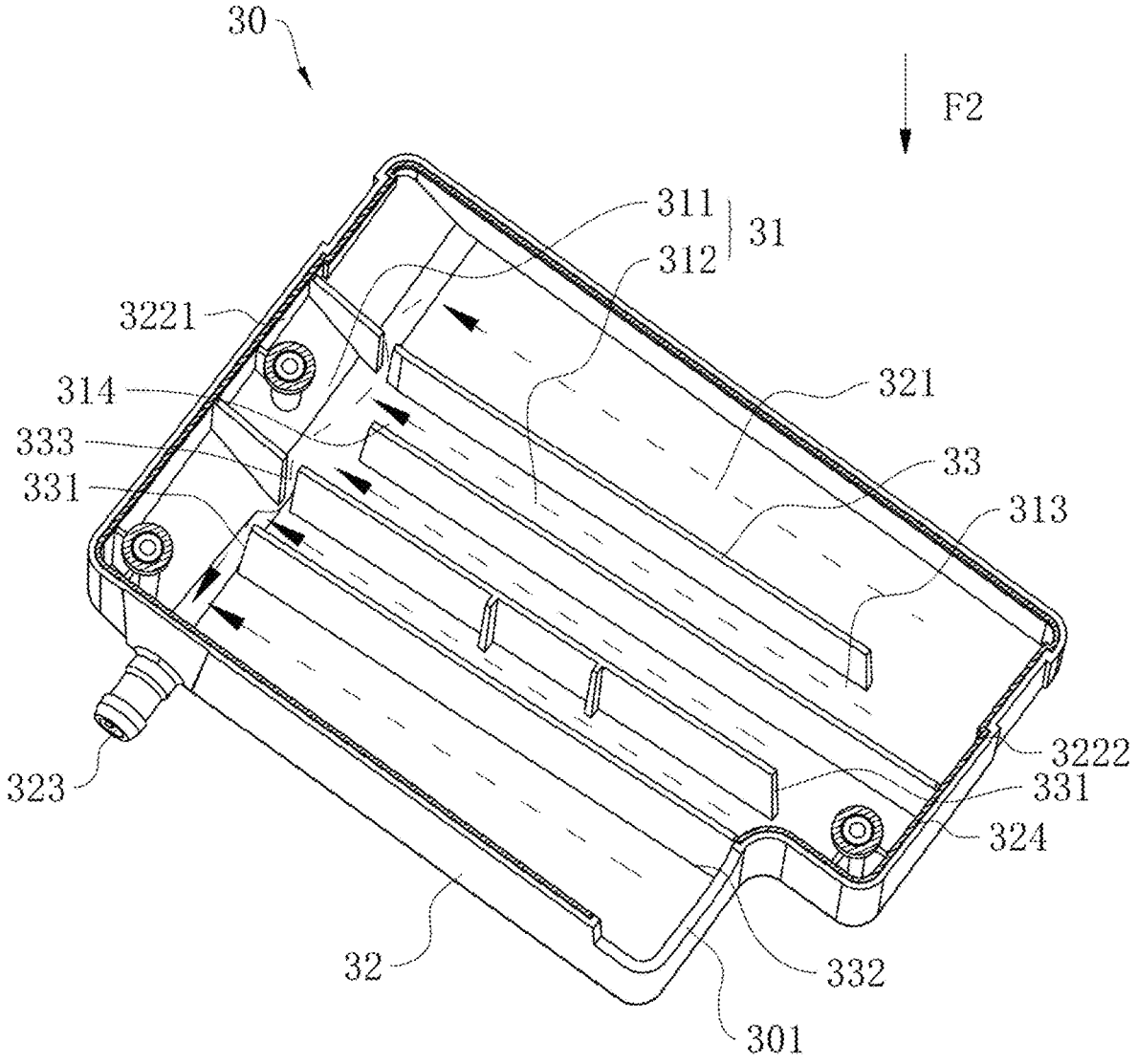
FIG. 8 is a perspective cross-sectional schematic diagram of the fog collecting box shown in FIG. 7.

In some embodiments, as shown in FIG. 8, the channel 31 includes at least two straight sections 312. Each of the bending sections 311 is communicated with corresponding two straight sections 312. Optionally, one of the bending sections 311 is communicated with the inlet 301 through one of the straight sections 312. Optionally, one of the bending sections 311 is communicated with the outlet 302 through one of the straight sections 312. Optionally, one of the bending sections 311 is communicated with another bending section 311 through one of the straight sections 312.

As shown in FIG. 8, two of the straight sections that communicated with the same bending section are disposed in parallel. The two of the straight sections 312 are disposed in parallel, so that a spacing between the two of the straight sections 312 is uniform, and a space occupied by the two of the straight sections 312 is reduced. Thus, an internal space of the fog collecting box 30 is fully utilized and the length of the channel 31 is allowed to be further increased.

As shown in FIG. 8, each of the straight sections 312 includes a first end 313 and a second end 314 opposite to the first end 313. Along a predetermined flow direction of the fog, the first end 313 of each of the straight sections 312 is closer to the outlet 302 of the fog collecting box than the second end 314 of each of the straight sections 312, and the second end 314 of each of the straight section 312 is closer to the inlet 301 of the fog collecting box than the first end 313 of each of the straight sections 312.

As shown in FIG. 8, in the predetermined mounting state, a height of the first end 313 of each of the straight sections 312 is greater than a height of the second end 314 of each of the straight sections 312. Furthermore, in the predetermined mounting state, in each two adjacent straight sections 312, a first one of the straight sections close to the inlet 301 is higher than a second one of the straight sections 312 close to the outlet 302. Furthermore, the fog collecting box 30 includes a fog liquid outlet 323 disposed near the inlet 301, Along the second reference direction F2 of the fog collecting box 30, a lowest point of the fog liquid outlet 323 is flush with one of the bending sections closest to the fog liquid outlet 323.

When the fog particles are gathered on the boundary surfaces of each of the straight sections 312 to form the fog liquid that is flowable, since the height of the first end 313 of each of the straight sections 312 is greater than the height of the second end 314 of each of the straight sections 312, each of the straight sections 312 guides the fog liquid to flow in a direction from the first end 313 thereof to the second end 314 thereof. Since in each two adjacent straight sections 312 are communicated through the same bending section, the bending sections 311 adjacent to corresponding second ends 314 of the straight sections are communicated with each other and are communicated with the fog liquid outlet 323. Therefore, the fog liquid flows to the second end 314 of each of the straight sections 312 continue to flow to a corresponding one of the bending sections. Further, a height of one of the bend sections close to the fog liquid outlet 323 is less than a height of another one of the bending section close to the outlet 302. Therefore, the fog liquid flows to the fog liquid outlet 323 along the bending sections 311 respectively connected to the second ends 314 of the straight sections. The fog liquid outlet 323 is configured to discharge the fog liquid flowing near the inlet 301. The fog liquid outlet 323 is communicated with the fog liquid reservoir 25 through a fog liquid conveying pipe, so that the fog liquid collected by the fog collecting box 30 is reused, thereby reducing consumption of the fog liquid. The flow direction of the fog liquid in the fog collecting box may refer to the dashed broken lines shown in FIG. 8.

As shown in FIGS. 7-8, in the predetermined mounting state, a height of a lower edge of the inlet 301 is greater than a height of the fog liquid outlet 323, thereby preventing the fog liquid from leaking from the inlet 301. It is understood that along the second reference direction F2, the fog liquid outlet 323 is below the lower edge of the inlet 301. Optionally, the height of the fog liquid outlet 323 is greater than a liquid level of the fog liquid in the fog liquid reservoir 25, so that the fog liquid in the fog collecting box 30 is able to flow to the fog liquid reservoir 25 under the gravity.

Optionally, the bubble machine 100 further includes a fog liquid pump 26. The fog liquid pump 26 is connected between the fog liquid outlet 323 and the fog liquid reservoir 25. The fog liquid pump 26 generates fluid pressure to make the fog liquid in the fog collecting box 30 flow to the fog liquid reservoir 25.

Figure 9:
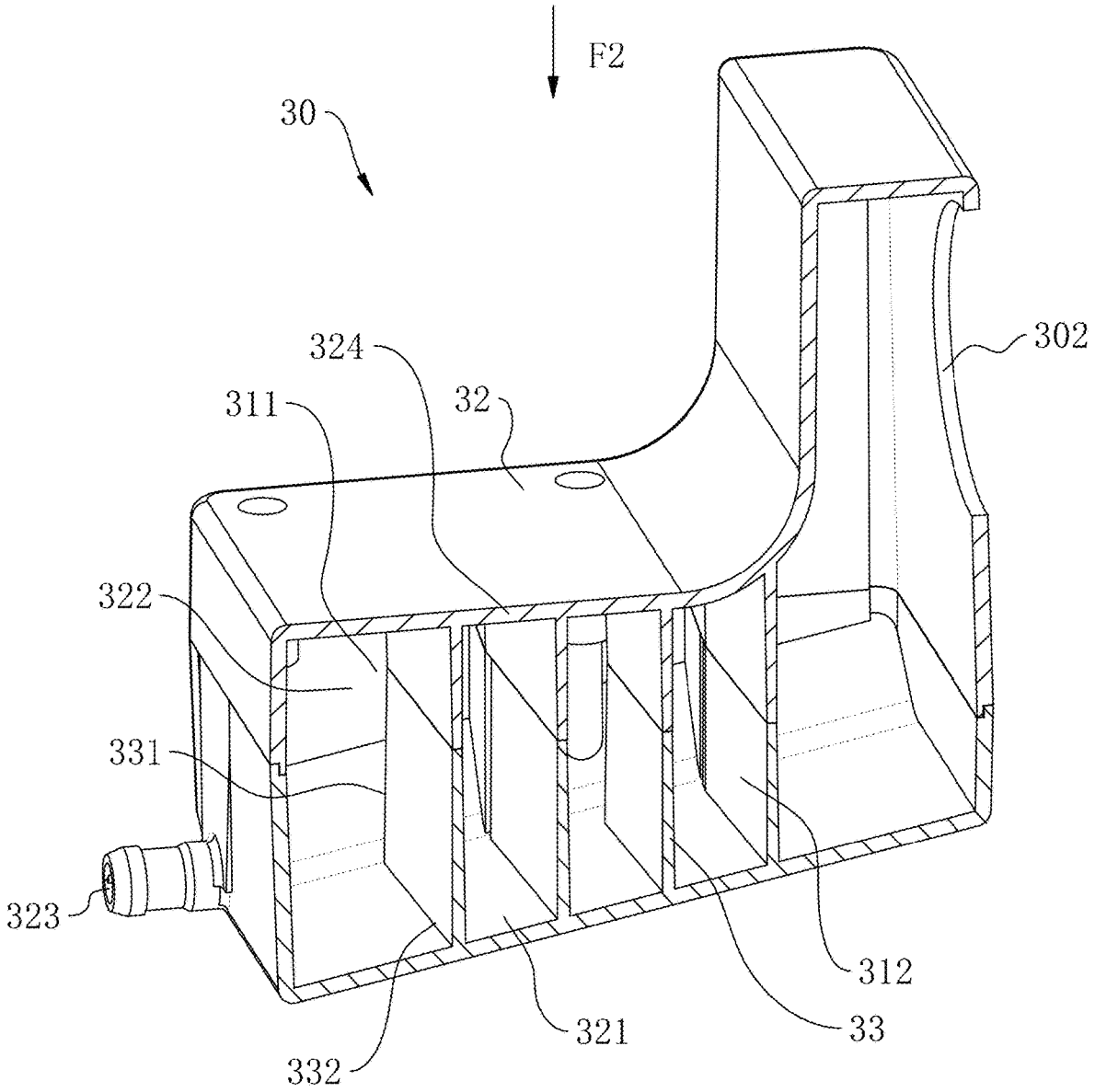
FIG. 9 is another perspective cross-sectional schematic diagram of the fog collecting box shown in FIG. 7.

As shown in FIG. 9, in the straight sections 312, a volume of a last straight section 312 away from the inlet 301 is greater than a volume of a first straight section 312 connected to the inlet 301. For example, starting from the first straight section 312 connected to the inlet 301, a height of the last straight section 312 is much greater than a height of the first straight section 312. A width and a length of the last straight section 312 are approximately the same as a width and a length of the first straight section 312. In some embodiments, the fog collecting box 30 includes three straight sections 312, and starting from the first straight section 312 connected to the inlet 301, heights of the three straight sections 312 increase in sequence. The last straight section 312 is connected to the outlet 302 and is relatively high, so as to facilitate the outlet 302 to dock with a suction end of the first airflow driving piece 24.

As shown in FIGS. 8-9, the fog collecting box 30 includes a shell 32 and at least one partition plate 33 accommodated in the shell 32. The inlet 301 and the outlet 302 are defined on the shell 32. The at least one partition plate 33 is disposed between the inlet 301 and the outlet 302 of the fog collecting box 30 to prevent the fog from linearly flowing to the outlet 302. The shell 32 and the at least one partition plate 33 jointly define the channel 31 of the fog collecting box 30. Specifically, since a volume of the shell 32 is fixed, by disposing the at least one partition plate 33 in the shell 32, a distance between each two opposite walls of walls inside the fog collecting box 30 is reduced while forming the channel 31. After the distance between each two opposite walls is reduced, when the fog passes between each two opposite walls, the fog particles are more likely to adhere to wall surfaces thereof, thereby effectively reducing the content of the fog particles in the fog.

As shown in FIGS. 8-9, the at least one partition plate includes partition plates 33. The shell 32 forms part of a boundary of the channel 31, so that the number of the partition plates 33 is reduced, which reduces the cost of the fog collecting box 30. Specifically, in the predetermined mounting state, the inlet 301 is defined on a horizontal side of the shell 32 or on a bottom side of the shell 32. Specifically, the outlet 302 is defined on another horizontal side of the shell 32 or on a top side of the shell 32. In other embodiments, the boundary of the channel 31 is formed by the partition plates 33 in the shell 32.

As shown in FIG. 8, the partitions 33 are disposed in a staggered manner. Specifically, the inner wall surface 322 of the shell 32 includes a first inner wall surface 3221 and a second inner wall surface opposite to the first inner wall surface 3221. In each two adjacent partitions 33, a first one of the two adjacent partitions 33 is connected to the first inner wall surface 3221, and a second one of the two adjacent partitions 33 is connected to the second inner wall surface 3222. Specifically, each of the partition plates 33 includes a first edge 331 and a second edge 332, a distance between the first edge 331 thereof and the shell 32 is greater than a distance between the second edge 332 thereof and the shell 32. Each first edge 331 and the shell 32 define a corresponding one of the bending sections 311. That is, each of the bending sections 311 of the channel 31 is defined between one end of each of the partition plates 33 and a corresponding inner wall surface 322 of the shell 32. Optionally, each second edge 332 is integrally connected to the shell 32. Optionally, each second edge 332 is sealed with and abutted against a corresponding inner wall surface 322 of the shell 32. Optionally, each second edge 332 may be spaced apart from the corresponding inner wall surface 322 of the shell 32.

It is understandable that in order to facilitate the flow of fog liquid in the fog collecting box 30, each partitions 33 that is connected to the first inner wall surface 3221 defines a notch 333, and the notch 333 thereof is disposed close to the first inner wall surface 3221. It is understandable that a passage formed by each notch 333 is a part of a corresponding one of the bending sections. Therefore, when the fog liquid flows from the first end 313 of each of the straight sections 312 to the second end 314 of each of the straight sections 312, the fog liquid is allowed to flow out from each notch 333 and then flow to the fog liquid outlet. Assuming that no notch is provided on each partition 33 that is connected to the first inner wall surface 3221, the fog liquid accumulated between each two adjacent partitions 33 is unable to flow out smoothly, which is not only not conducive to the recovery of the fog liquid, but also hinders the normal flow of the fog in the fog collecting box 30, resulting in more and more fog liquid accumulation, and affecting the normal use of the fog collecting box 30.

Each of the bending sections 311 of the channel 31 penetrates through a corresponding one of the partition plates 33. It is understood that a through hole is defined on each of the partition plates 33, and an inner edge of each through hole is configured as a boundary of a corresponding one of the bending sections 311.

In one optional embodiment, the at least one partition plates includes only one partition plate 33 disposed in the shell 32, and the at least one bending section includes only one bending section. Furthermore, relative to a straight line connecting the inlet 301 and the outlet 302, the one bending section 311 corresponding to the one partition plate 33 is outside the straight line connecting the inlet 301 and the outlet 302. A distance between the ONE bending section 311 and the straight line connecting the inlet 301 and the outlet 302 is close to a horizontal width of the shell 32, which effectively increases the length of the channel 31.

In another optional embodiment, as shown in FIG. 8, the at least one partition plates includes the partition plates 33 disposed in the shell 32, and the at least one bending section includes the bending sections. The partition plates 33 are linearly spaced apart from each other. Specifically, an internal space of the shell 32 is divided by the partition plates 33, so that a total length of the channel 31 effectively increases, and the distance between each two opposite walls of the walls is effectively reduced. Optionally, in the predetermined mounting state, a linear distribution direction of the partition plates 33 is roughly parallel to the horizontal direction. Optionally, in the predetermined mounting state, the linear distribution direction of the partition plates 33 is roughly parallel to the vertical direction. It is understood that the partition plates 33 are roughly perpendicular to the second reference direction F2, or the partition plates 33 are roughly parallel to the second reference direction F2.

As shown in FIG. 8, each of the straight sections 312 is formed between each two adjacent partition plates 33 disposed opposite to each other. Optionally, in the predetermined mounting state, each two adjacent partition plates 33 opposite to each other in the horizontal direction respectively form horizontal boundaries of two sides of each of the straight sections 312. The inner wall surfaces 322 of the shell 32 define an upper boundary and a lower boundary of each of the straight sections 312. Optionally, in the predetermined mounting state, each two adjacent two partition plates 33 opposite to each other in the vertical direction respectively form upper boundaries and lower boundaries of two sides of each of the straight sections 312, and the inner wall surfaces 322 of the shell 32 define a horizontal boundary of each of the straight sections 312.

In some embodiments, as shown in FIG. 8, between each two adjacent partition plates 33, first edges 331 of the two partition plates 33 are disposed in opposite directions, so that two of the bending sections 311 corresponding to the two partition plates 33 have a larger distance, which increase the length of the channel 31.

The three partition plates 33 disposed in sequence are briefly described as a first partition plate, a second partition plate, and a third partition. One end of the first partition away from the first edge 331 thereof and one end of the third partition away from the first edge 331 thereof are respectively connected to a portion of the inner wall surfaces 322 of the shell 32. The first edge 331 of the second partition plate is spaced apart from the portion of the inner wall surfaces 322 of the shell 32. It is understood that one bending section 311 is between the first partition plate and the third partition plate. Meanwhile, the bending section 311 passes through the portion of the inner wall surfaces 322 of the shell 32 and the first edge 331 of the second partition plate. More specifically, before the fog passes through the bending sections 311, the flow direction thereof is parallel to the second partition plate and toward the portion of the inner wall surfaces 322 of the shell 32. After the fog passes through the bending section 311, the flow direction thereof is parallel to the second partition plate and away from the portion of the inner wall surfaces 322 of the shell 32.

Optionally, the partition plates 33 may cooperate with three inner wall surfaces 322 of the shell 32 to form the bending sections 311. Optionally, a first inner wall surfaces 322 of the shell 32 is perpendicular to a second inner wall surfaces 322 of the shell 32, and the second inner wall surfaces 322 of the shell 32 is perpendicular to a third inner wall surfaces 322 of the shell 32. Optionally, each two adjacent inner wall surfaces 322 of the three inner wall surfaces 322 may have other forms of angle relationships.

When each of the partition pleats 33 define the through hole, for each two adjacent partition plates 33, a linear distance between two through holes of the two adjacent partition plates 33 is greater than a linear distance between the two adjacent partition plates 33, so that the bending sections 311 corresponding to the two adjacent partition plates 33 have a larger size, which increases the length of the channel 31.

The shape of each of the partition plates 33 may be a regular shape or an irregular shape. Specifically, the regular shape thereof includes but is not limited to a rectangle and an arc. Optionally, when at least two partitions plates 33 are provided, shapes of the partition plates 33 may be the same or different.

As shown in FIGS. 8-9, inner sides of the shell 32 includes a bottom surface 321. In the predetermined mounting state, a height of a first side of the bottom surface 321 of the shell32 is lower than a height of a second side of the bottom surface 321 of the shell 32, and the first side of the bottom surface 321 of the shell 32 is closer to the inlet 301 of the fog collecting box 30 than the second side of the bottom surface 321 of the shell 32. Specifically, when the fog particles are gathered on the boundary surfaces of the straight sections 312 to form the fog liquid, under the gravity, the bottom surface 321 of the shell 32 guide the fog liquid to gradually flow to the position close to the inlet 301, thereby facilitating the collecting and reuse of the fog liquid. It is understood that along the second reference direction F2, the first side of the bottom surface 321 close to the inlet 301 is below the second side of the bottom surface 321.

Optionally, inner sides of the shell 32 includes a top surface. In the predetermined mounting state, the top surface is above the bottom surface 321 of the shell 32. The top surface and the bottom surface 321 of the shell form a boundary of the channel 31. It is understood that along the second reference direction F2, the bottom surface 321 is below the top surface of the shell 32.

As shown in FIGS. 8-9, the shell 32 includes shell walls 324. The shell walls 324 enclose an internal space. The partition plates33 are disposed in the internal space to define the channel 31. Specifically, the shell walls 324 include pairs of shell walls 324 disposed opposite to each other. In the predetermined mounting state, a first pair of shell walls 324 are disposed at intervals along the second reference direction F2, and the first pair of shell walls 324 is configured to form the upper boundary and the lower boundary of the channel 31, and one of first pair of shell walls 324 on a lower side defines the fog liquid outlet 323. A second pair of shell walls 324 are disposed at intervals along the horizontal direction from left to right, and the second pair of shell walls 324 are configured to form the boundary of the at least one bending section 311. Optionally, the first edge 331 of the at least one partition plate 33 is opposite to and spaced apart from the second pair of shell walls 324. A third pair of shell walls 324 are disposed at intervals along the horizontal directions from front to rear, and a first one of the third pair of shell walls 324 defines the inlet 301, and a second one of the third pair of shell walls 324 defines the outlet 302.

In other embodiments, pipe bodies are disposed inside the fog collecting box 30, and the channel 31 is defined by the pipe bodies.

The fog collecting box 30 in the bubble machine 100 shown in FIGS. 10A-18 is connected and communicated with the film forming nozzle 21 through a return pipe 50. The return pipe 50 is configured to convey the fog liquid from the film forming nozzle 21 to the fog collecting box 30. As shown in FIGS. 1-18, the fog liquid in the fog collecting box 30 is allowed to flow back into the fog liquid reservoir 25 through the fog liquid outlet 323, so that the fog liquid is reused. In other optional embodiments, the return pipe 50 is not connected and communicated with the fog collecting box 30, and the return pipe 50 is connected and communicated with the fog liquid reservoir 25, so that the return pipe 50 directly convey the fog liquid from the return port 211 to the fog liquid reservoir 25, and the fog liquid is reused. The return pipe 50 is so allowed to convey the fog liquid to other position.

It should be noted that part of the fog condenses in the bubble channel 212 of the film forming nozzle 21 to form the fog liquid and flows to the outlet 214 of the film forming nozzle 21, which may affect the film scraping body 22 to move back and forth at the outlet 214 to form the bubble film. For instance, the first airflow driving piece 24, such as the first fan, drives the fog in the fog collecting box 30 into the bubble channel 212 of the film forming nozzle 21. During the rotation of fan blades of the first fan, part of the fog is condensed to form the fog liquid, and the fog liquid is blown into the bubble channel 212 and is blown to the outlet 214 of the film forming nozzle 21 by the first fan, thereby affecting the film scraping body 22 to move back and forth at the outlet 214 to form the bubble film. Based on this, the embodiment of the present disclosure provides the return port 211 on the film forming nozzle 21. The return port 211 is communicated with the return pipe 50. The fog liquid in the bubble channel 212 flows from the return port 211 to the return pipe 50, so that the return pipe 50 conveys the fog liquid in the film forming nozzle 21 to the fog collecting box 30 or the fog liquid reservoir 25, which not only realizes the reuse of the fog liquid, but also reduces or even avoids the fog liquid in the bubble channel 212 of the film forming nozzle 21 from flowing to the outlet 214 and affecting the generation of the bubble film on one side of the outlet 214.

Specifically, the inlet 301, the outlet 302, the channel 31, the at least one partition plates 33, and the shell 32 of the fog collecting box 30 in the bubble machine 100 shown in FIGS. 10A to 18 may refer to the fog collecting box 30 shown in FIGS. 1-9, which are not repeatedly described herein. In other optional embodiments, there is no partition plate disposed inside the fog collecting box 30 of the bubble machine 100 shown in FIGS. 10A-18, so that an interior of the fog collecting box 30 is an integral cavity.

For instance, as shown in FIGS. 10A-18, the film forming nozzle 21 defines a bubble channel 212, an inlet 213, an outlet 214, and a return port 211. The inlet 213, the outlet 214, and the return port 211 are communicated with the bubble channel 212. The inlet 213 and the outlet 214 of the film forming nozzle 21 are respectively defined on two sides of the bubble channel 212. The inlet 213 of the film forming nozzle 21 is communicated with the bubble solution reservoir 23 and the fog collecting box 30. A first end of the return pipe 50 is connected to the film forming nozzle 21 and is communicated with the return port 211. A second end of the return pipe 50 is connected to and communicated with the fog collecting box 30 or the fog liquid reservoir 25. The return pipe 50 is configured to convey liquid such as the fog liquid from the return port 211 to the fog collecting box 30 or the fog liquid reservoir 25. It is understood that the return pipe 50 is hollow.

Optionally, as shown in FIGS. 10A-18, the return pipe 50 is connected to the film forming nozzle 21 through a conveying component 40, and the return pipe 50 is communicated with the return port 211 through the conveying component 40.

Optionally, as shown in FIGS. 10A-18, the conveying component 40 includes a connecting pipe 42 and a receiving portion 41 communicated with the connecting pipe 42. The receiving portion 41 is disposed corresponding to the return port 211. The receiving portion 41 is configured to receive the liquid (i.e., the fog liquid) from the return port 211. The connecting pipe 42 is connected to and communicated with the return pipe 50. The connecting pipe 42 is configured to convey the liquid from the return port 211 to the return pipe 50.

Figure 10A:
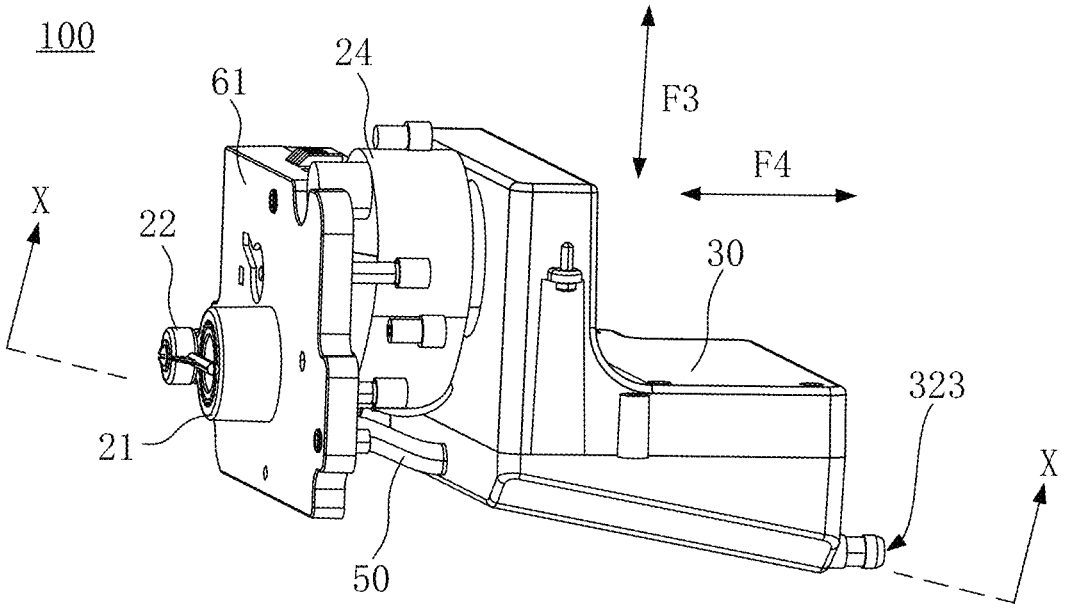
FIG. 10A is a partial schematic diagram of the bubble machine of the present disclosure.
Figure 10B:
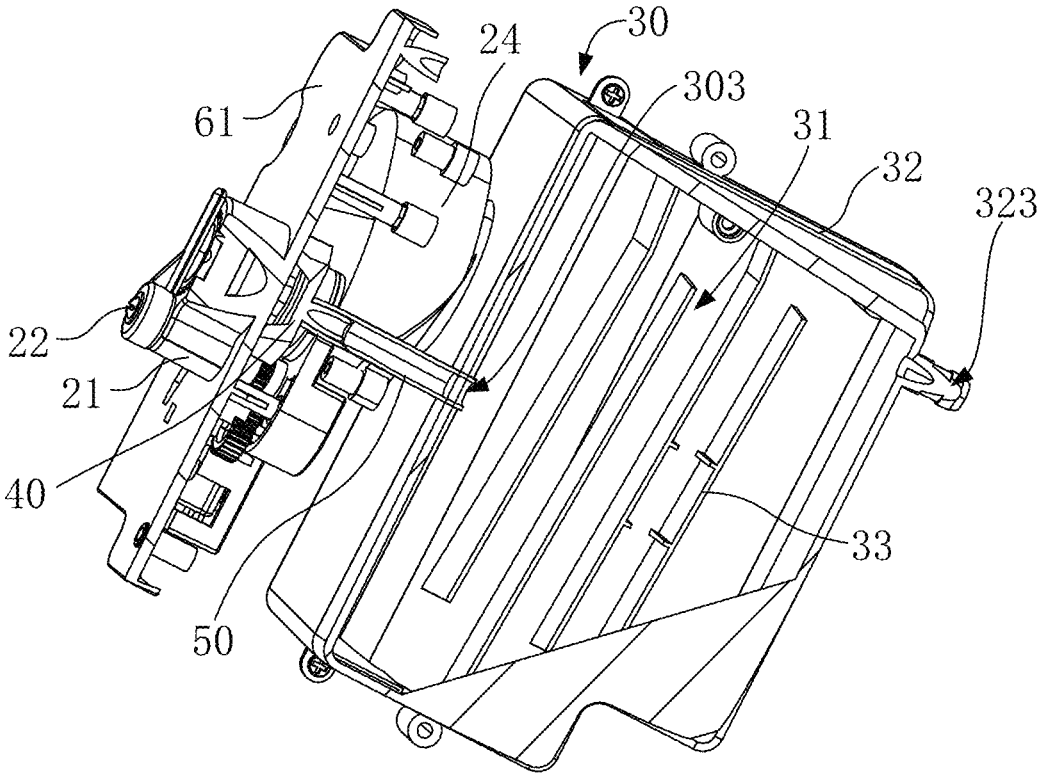
FIG. 10B is a cross-sectional schematic diagram of the bubble machine taken along a line X-X shown in FIG. 10A.
Figure 11A:
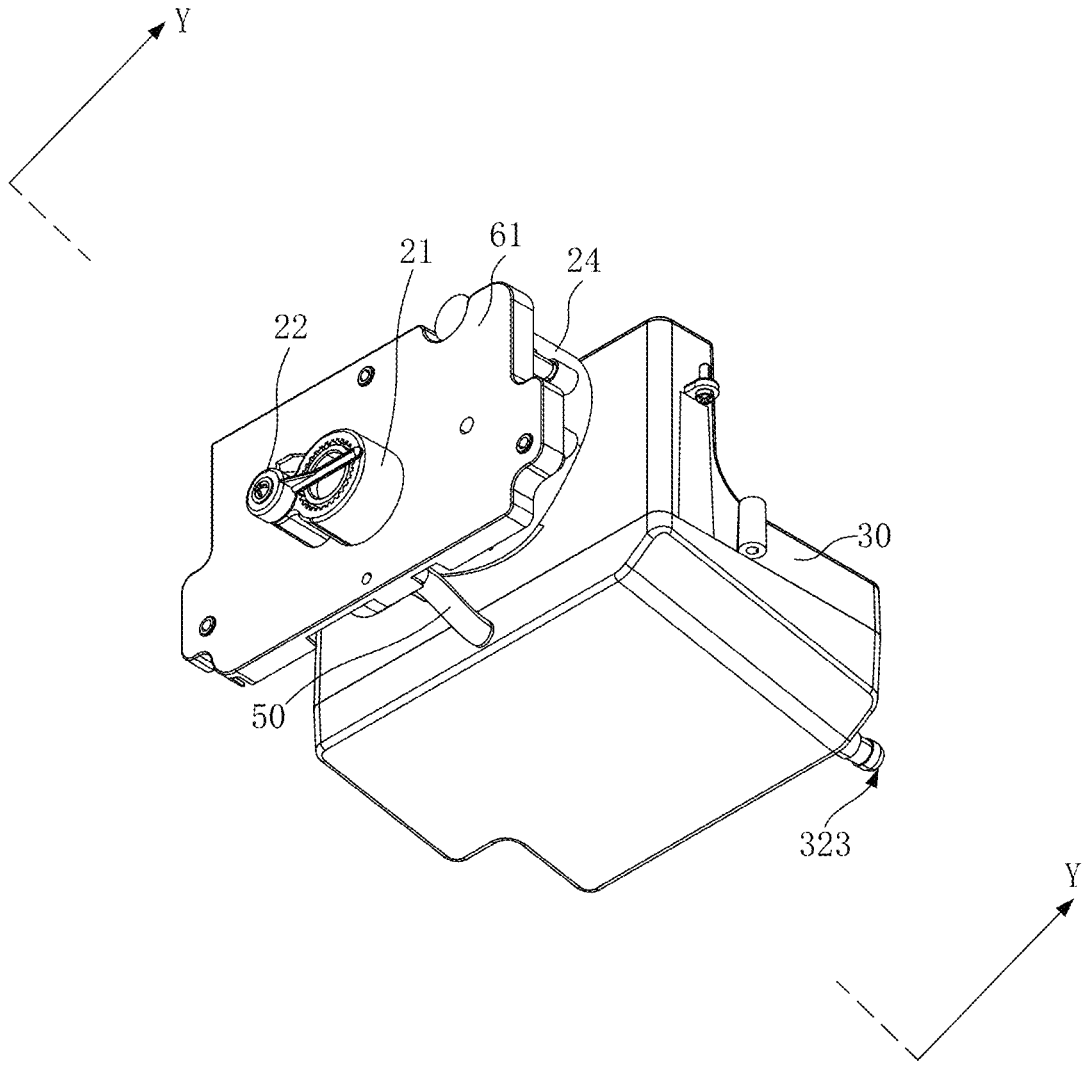
FIG. 11A is a partial schematic diagram of the bubble machine of the present disclosure.
Figure 11B:
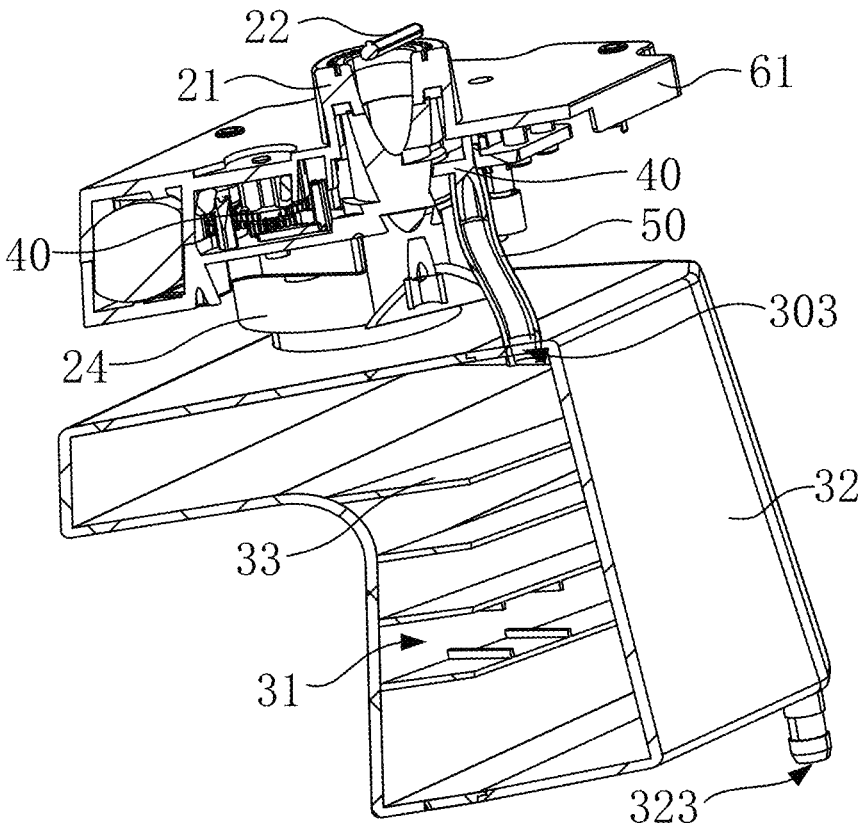
FIG. 11B is a cross-sectional schematic diagram of the bubble machine taken along a line Y-Y shown in FIG. 11A.
Figure 12A:
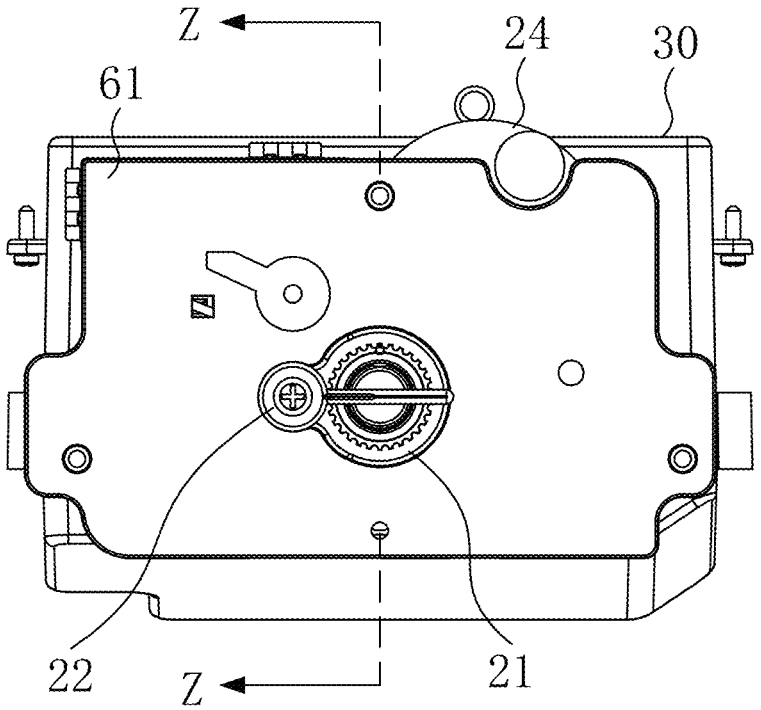
FIG. 12A is a partial schematic diagram of the bubble machine of the present disclosure.
Figure 12B:
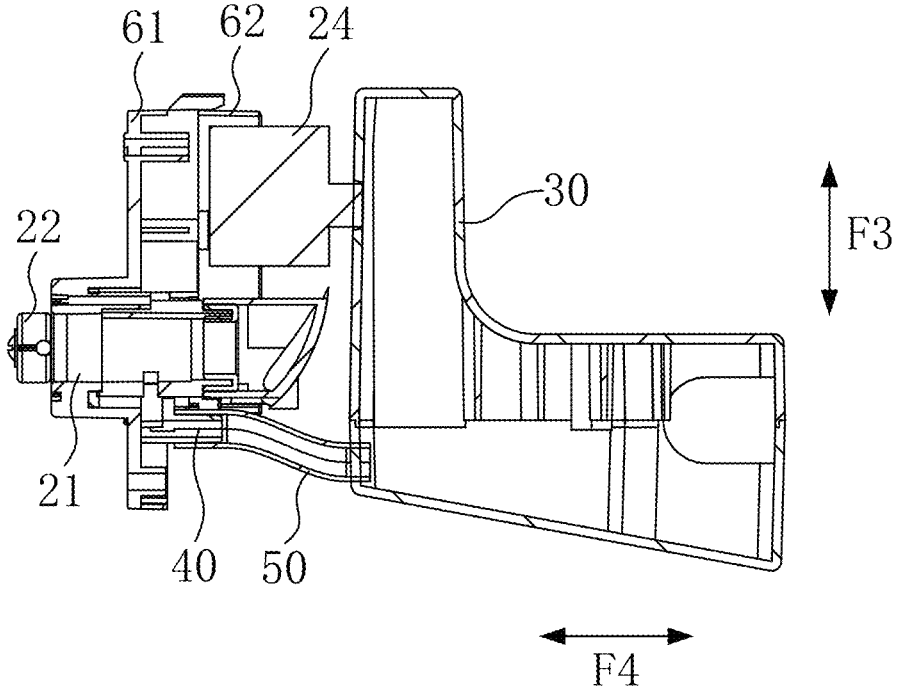
FIG. 12B is a cross-sectional schematic diagram of the bubble machine taken along a line Z-Z shown in FIG. 12A.
Figure 13:
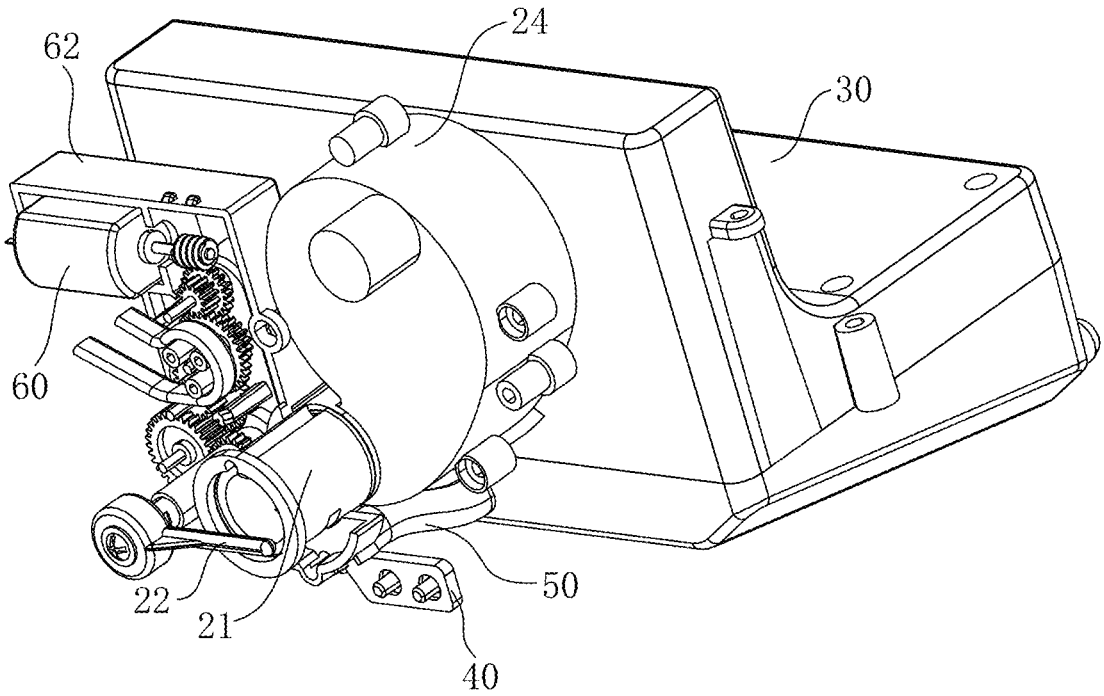
FIG. 13 is another partial schematic diagram of the bubble machine of the present disclosure.
Figure 14:
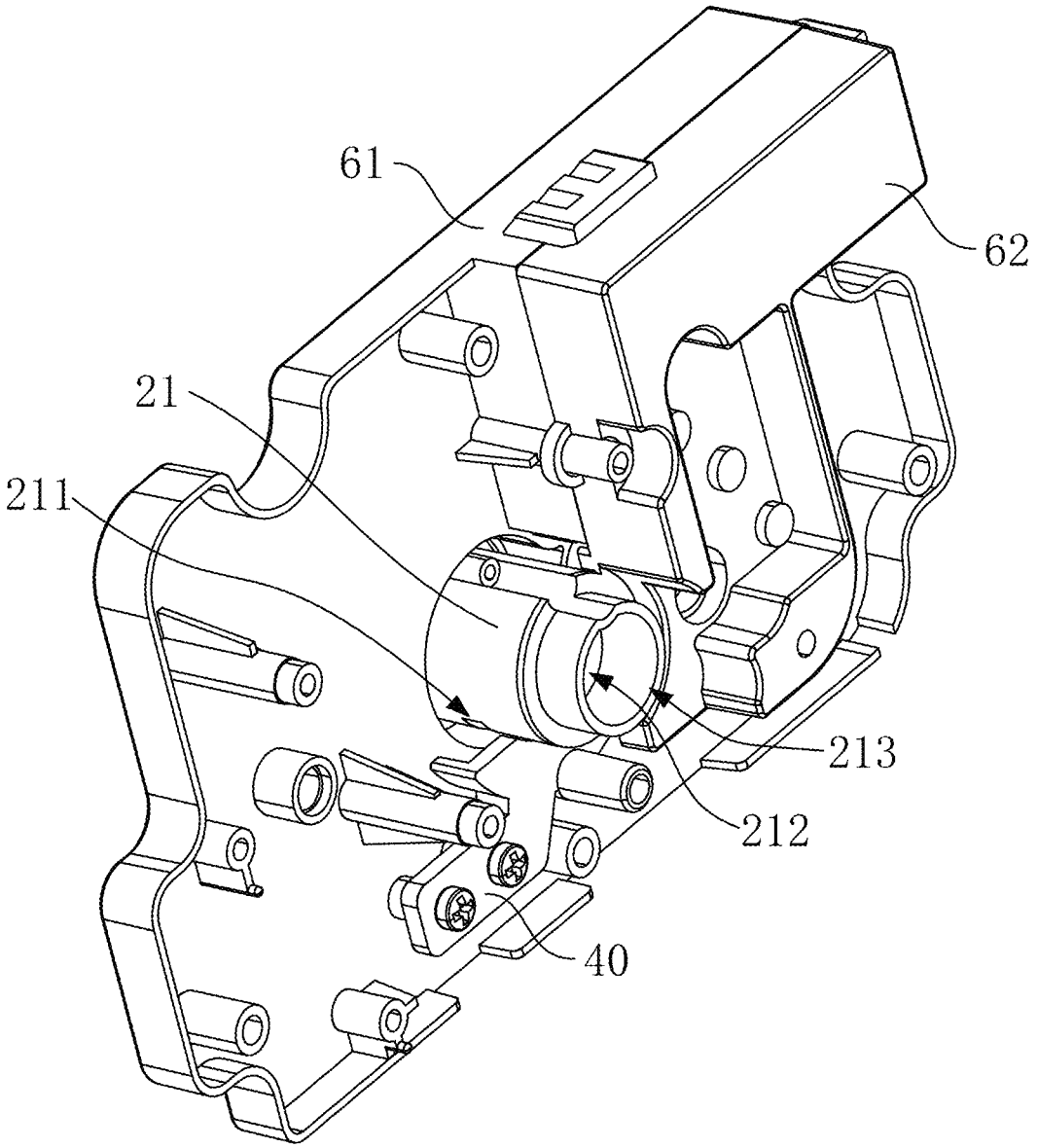
FIG. 14 is another partial schematic diagram of the bubble machine of the present disclosure.
Figure 15:
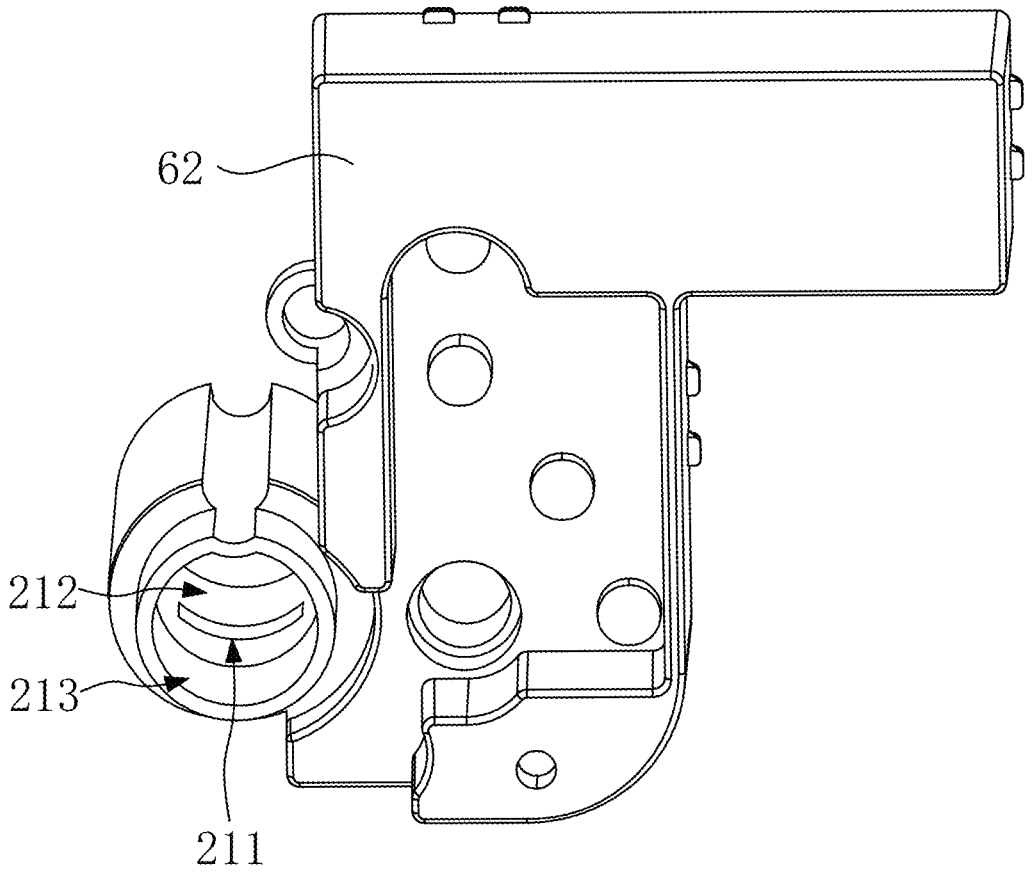
FIG. 15 is another partial schematic diagram of the bubble machine of the present disclosure.
Figure 16:
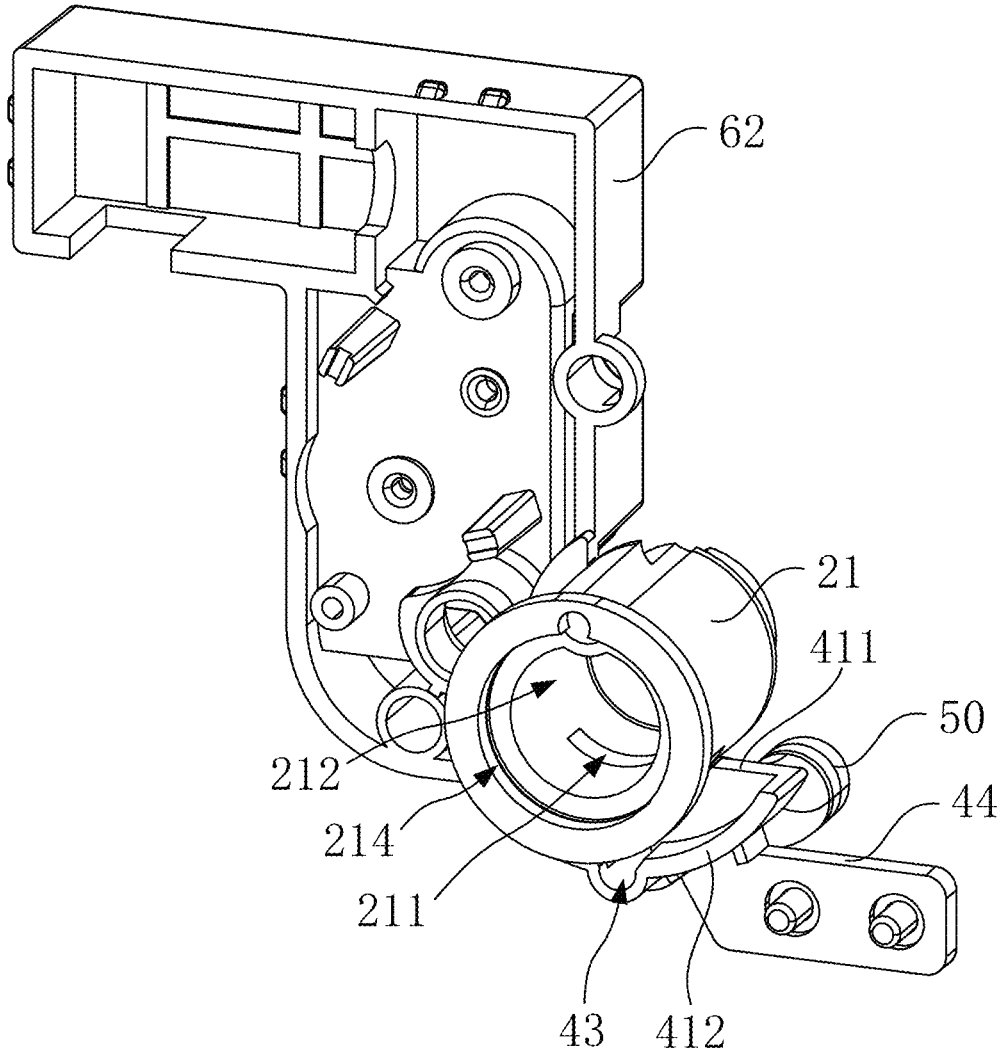
FIG. 16 is another partial schematic diagram of the bubble machine of the present disclosure.
Figure 17:
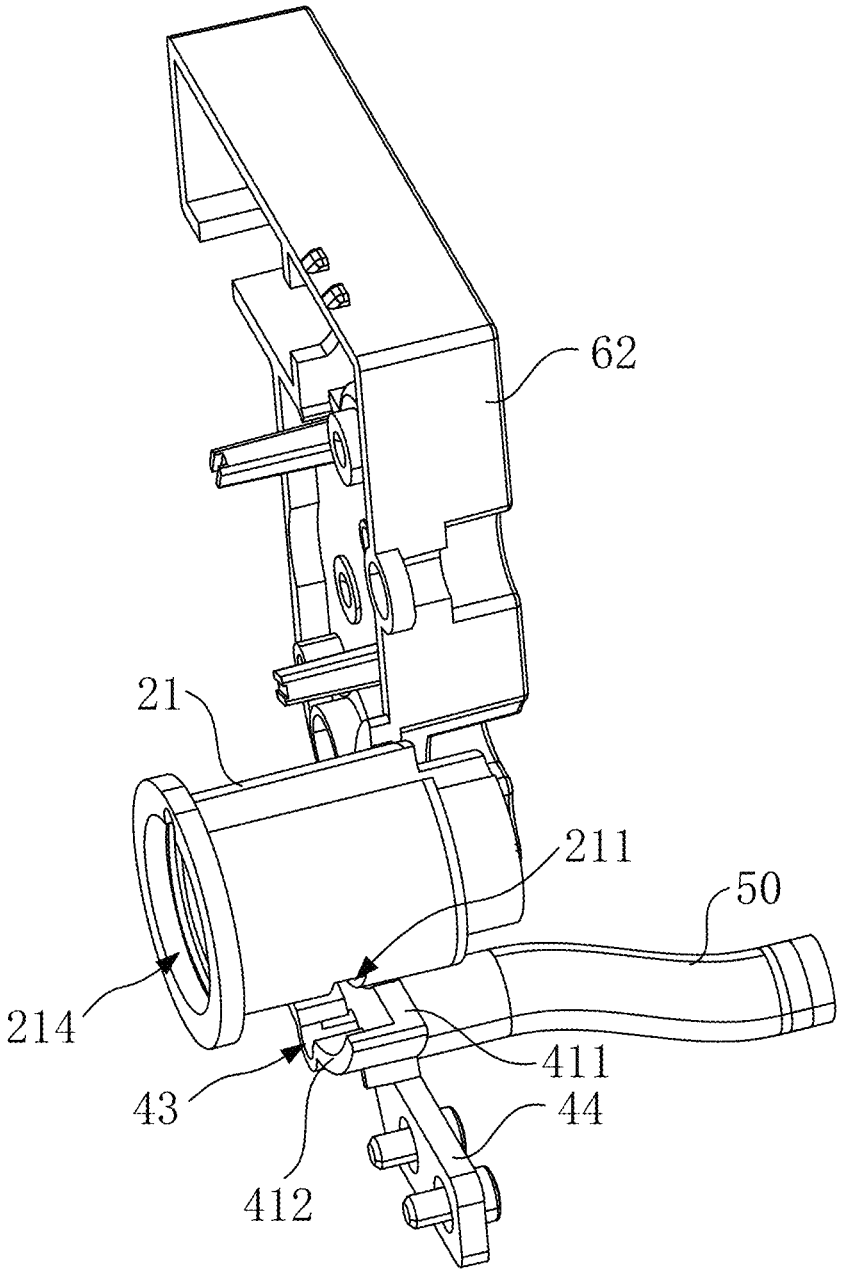
FIG. 17 is another partial schematic diagram of the bubble machine of the present disclosure.
Figure 18:
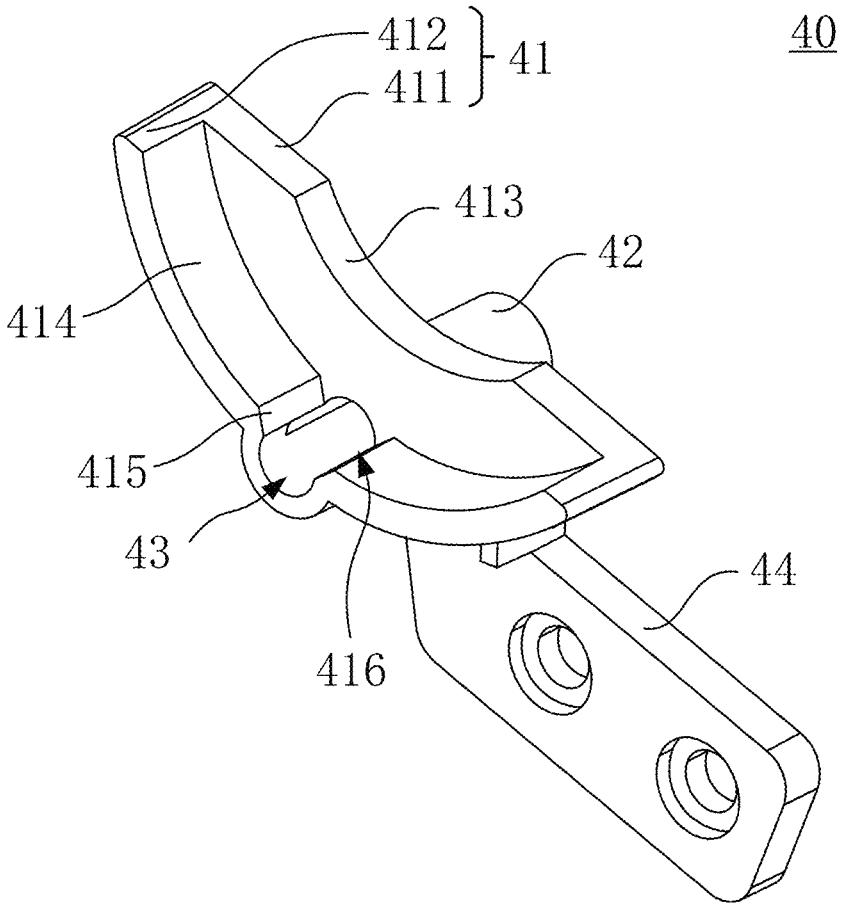
FIG. 18 is a schematic diagram of a conveying component of the bubble machine of the present disclosure.

Optionally, as shown in FIGS. 10A and 12B, the bubble machine 100 defines a height direction F3 and a length direction F4. The first reference direction F1 shown in FIG. 2 is understood as the height direction F3 of the bubble machine 100.

Optionally, as shown in FIGS. 10A-18, the conveying component 40 includes a first portion 411 and a second portion 412. The first portion 411 and the second portion 412 are connected to each other along the length direction of the bubble machine 100. The first portion 411 is disposed below the return port 211 along the height direction F3 of the bubble machine 100. The first portion 411 is spaced apart from an outer surface of the film forming nozzle 21. The second portion 412 is disposed below the film forming nozzle 21 along the height direction F3 of the bubble machine 100. The second portion 412 is attached to or spaced apart from the outer surface of the film forming nozzle 21.

Optionally, as shown in FIGS. 10A-18, the connecting pipe 42 is sleeved with the return pipe 50. The conveying component 40 further includes a conveying channel 43. The conveying channel 43 penetrates through the first portion 411, the second portion 412, and the connecting pipe 42. The conveying channel 43 is communicated with the return port 211 and the return pipe 50, and the conveying channel 43 is disposed in a bottom portion of the conveying component 40 along the height direction F3.

Optionally, as shown in FIGS. 10A-18, the first portion 411 includes a notch 416 communicated with the conveying channel 43. The first portion 411 further includes two first arc-shaped surfaces 414 separated by the notch 416 and two inclined surfaces 415 separated by the notch 416. The notch 416 is disposed below the return port 211 along the height direction F3. Each of the first arc-shaped surfaces 414 is connected to a corresponding one of the inclined surfaces 415, and the two inclined surfaces 415 are closer to the conveying channel 43 than the two first arc-shaped surfaces 414.

Optionally, as shown in FIGS. 10A-18, the second portion 412 includes second arc-shaped surfaces 414, and a radian of at least one of the first arc-shaped surfaces and a radian of the second arc-shaped surfaces 414 are the same as a radian of the outer surface of the film forming nozzle 21.

In other embodiment, the return pipe 50 is directly connected to the film forming nozzle 21 and is directly communicated with the return port 211. For instance, a sleeve portion is directly disposed on a position of the film forming nozzle 2 corresponding to the return port 211, and the sleeve portion is directly sleeved with the return pipe 50.

Optionally, as shown in FIGS. 10A-18, the bubble machine 100 further includes a first mounting shell 61. The film forming nozzle 21 is connected to the first mounting shell 61. The first portion 411 is fixedly connected to the first mounting shell 61. A surface of the first portion 411 away from the second portion 412 is attached to the first mounting shell 61. The first portion 411 is limited between the first mounting shell 61 and the second portion 412. A spacing region between the return port 211 and the second portion 412 is defined by the first mounting shell 61 and the second portion 412. The conveying component 40 further includes a connecting portion 44 fixedly connected to the first portion 411 and/or the second portion 412. The connecting portion 44 is connected to the first mounting shell 61, for example, the connecting portion 44 is connected to the first mounting shell 61 by screws.

Optionally, as shown in FIGS. 10A-18, the bubble machine 100 further includes a driving mechanism 60 and a second mounting shell 62. A first part of the film forming nozzle 21 is connected to the first mounting shell 61. A second part of the film forming nozzle 21 is connected to the second mounting shell 62. The driving mechanism 60 is disposed on the first mounting shell 61 and the second mounting shell 62. The driving mechanism 60 is connected to the film scraping body 22 and is configured to drive the film scraping body 22 to move. The first mounting shell 61 and the second mounting shell 62 are connected.

Optionally, as shown in FIGS. 10A-18, the return port 211 is disposed at a middle position of the film forming nozzle 21. Alternatively, the return port 211 is closer to the outlet of the film forming nozzle 21 than the inlet of the film forming nozzle 21. Alternatively, the return port 211 is closer to the inlet of the film forming nozzle 21 than the outlet of the film forming nozzle 21.

What is claimed is:

1. A bubble machine, comprising:

a bubble solution reservoir configured to store bubble solution;

a fog liquid reservoir configured to store fog liquid;

a fog collecting box;

a film forming nozzle; and a return pipe;

wherein the fog collecting box is configured to store fog generated by atomization of the fog liquid in the fog liquid reservoir;

wherein the film forming nozzle comprises a bubble channel and an inlet, an outlet, and a return port, wherein the inlet, the outlet, and the return port are communicated with the bubble channel, the inlet of the film forming nozzle and the outlet of the film forming nozzle are respectively disposed on two sides of the bubble channel, and the inlet of the film forming nozzle is communicated with the bubble solution reservoir and the fog collecting box;

wherein a first end of the return pipe is connected to the film forming nozzle and is communicated with the return port;

wherein a second end of the return pipe is connected to and communicated with the fog collecting box or the fog liquid reservoir, and the return pipe is configured to convey a liquid from the return port to the fog collecting box or the fog liquid reservoir;

wherein the fog collecting box comprises an inlet, an outlet, and a fog liquid outlet;

wherein a channel is formed in the fog collecting box, and the channel of the fog collecting box is communicated with the inlet, the outlet, and the fog liquid outlet of the fog collecting box, the fog liquid outlet is communicated with the fog liquid reservoir, and the fog liquid outlet is configured to convey the fog liquid in the fog collecting box to the fog liquid reservoir;

wherein the fog collecting box comprises a shell and at least one partition plate accommodated in the shell, the at least one partition plate is disposed between the inlet and the outlet of the fog collecting box, and the shell and the at least one partition plate jointly define the channel of the fog collecting box.

2. The bubble machine according to claim 1, wherein the return pipe is directly connected to the film forming nozzle and is directly communicated with the return port; or the return pipe is connected to the film forming nozzle through a conveying component, and the return pipe is communicated with the return port through the conveying component.

3. The bubble machine according to claim 2, wherein the conveying component comprises a connecting pipe and a receiving portion communicated with the connecting pipe, the receiving portion is disposed corresponding to the return port, the receiving portion is configured to receive liquid from the return port, the connecting pipe is connected to and communicated with the return pipe, and the connecting pipe is configured to convey the liquid from the return port to the return pipe.

4. The bubble machine according to claim 2, wherein the bubble machine defines a height direction and a length direction, the conveying component comprises a first portion and a second portion, the first portion and the second portion are connected to each other along the length direction of the bubble machine, the first portion is disposed below the return port along the height direction of the bubble machine, the first portion is spaced apart from an outer surface of the film forming nozzle, the second portion is disposed below the film forming nozzle along the height direction of the bubble machine, and the second portion is attached to or spaced apart from the outer surface of the film forming nozzle.

5. The bubble machine according to claim 4, wherein the conveying component further comprises a connecting pipe, the connecting pipe is sleeved with the return pipe, the conveying component further comprises a conveying channel, and the conveying channel penetrates through the first portion, the second portion, and the connecting pipe;

wherein the conveying channel is communicated with the return port and the return pipe, and the conveying channel is disposed in a bottom portion of the conveying component along the height direction.

6. The bubble machine according to claim 5, wherein the first portion comprises a notch communicated with the conveying channel, the first portion further comprises two first arc-shaped surfaces separated by the notch and two inclined surfaces separated by the notch, the notch is disposed below the return port along the height direction, each of the first arc-shaped surfaces is connected to a corresponding one of the inclined surfaces, and the two inclined surfaces are closer to the conveying channel than the two first arc-shaped surfaces.

7. The bubble machine according to claim 4, wherein the first portion comprises at least one first arc-shaped surface, and the second portion comprises second arc-shaped surfaces, and a radian of the at least one first arc-shaped surface and a radian of the second arc-shaped surfaces are the same as a radian of the outer surface of the film forming nozzle.

8. The bubble machine according to claim 4, wherein the bubble machine further comprises a first mounting shell, the film forming nozzle is connected to the first mounting shell, the first portion is fixedly connected to the first mounting shell, a surface of the first portion away from the second portion is attached to the first mounting shell, a position of the first portion is limited between the first mounting shell and the second portion, and a spacing region between the return port and the second portion is defined by the first mounting shell and the second portion.

9. The bubble machine according to claim 1, wherein the bubble machine further comprises a first mounting shell, a driving mechanism, a second mounting shell, and a first airflow driving piece;

wherein a first part of the film forming nozzle is connected to the first mounting shell, a second part of the film forming nozzle is connected to the second mounting shell, the driving mechanism is disposed on the first mounting shell and the second mounting shell, the first airflow driving piece is connected to the film forming nozzle and the fog collecting box, the first airflow driving piece is communicated with the inlet of the film forming nozzle and an outlet of the fog collecting box, and the first airflow driving piece is configured to convey fog in the fog collecting box into the bubble channel of the film forming nozzle.

10. The bubble machine according to claim 1, wherein the return port is disposed at a middle position of the film forming nozzle; or the return port is closer to the outlet of the film forming nozzle than the inlet of the film forming nozzle; or the return port is closer to the inlet of the film forming nozzle than the outlet of the film forming nozzle.

11. A bubble machine, comprising:

a bubble solution reservoir configured to store bubble solution;

a fog liquid reservoir configured to store fog liquid;

a fog collecting box;

a film forming nozzle; and a return pipe;

wherein the fog collecting box is configured to store fog generated by atomization of the fog liquid in the fog liquid reservoir;

wherein the film forming nozzle comprises a bubble channel and an inlet, an outlet, and a return port, wherein the inlet, the outlet, and the return port are communicated with the bubble channel, the inlet of the film forming nozzle and the outlet of the film forming nozzle are respectively disposed on two sides of the bubble channel, and the inlet of the film forming nozzle is communicated with the bubble solution reservoir and the fog collecting box;

wherein a first end of the return pipe is connected to the film forming nozzle and is communicated with the return port;

wherein the bubble machine further comprises a first mounting shell, a driving mechanism, a second mounting shell, and a first airflow driving piece;

wherein a second end of the return pipe is connected to and communicated with the fog collecting box or the fog liquid reservoir, and the return pipe is configured to convey the liquid from the return port to the fog collecting box or the fog liquid reservoir;

wherein a first part of the film forming nozzle is connected to the first mounting shell, a second part of the film forming nozzle is connected to the second mounting shell, the driving mechanism is disposed on the first mounting shell and the second mounting shell, the first airflow driving piece is connected to the film forming nozzle and the fog collecting box, the first airflow driving piece is communicated with the inlet of the film forming nozzle and an outlet of the fog collecting box, and the first airflow driving piece is configured to convey fog in the fog collecting box into the bubble channel of the film forming nozzle.

12. A bubble machine, comprising:

a bubble solution reservoir configured to store bubble solution;

a fog liquid reservoir configured to store fog liquid;

a fog collecting box;

a film forming nozzle; and a return pipe;

wherein the fog collecting box is configured to store fog generated by atomization of the fog liquid in the fog liquid reservoir;

wherein the film forming nozzle comprises a bubble channel and an inlet, an outlet, and a return port, wherein the inlet, the outlet, and the return port are communicated with the bubble channel, the inlet of the film forming nozzle and the outlet of the film forming nozzle are respectively disposed on two sides of the bubble channel, and the inlet of the film forming nozzle is communicated with the bubble solution reservoir and the fog collecting box;

wherein a first end of the return pipe is connected to the film forming nozzle and is communicated with the return port;

wherein the return pipe is connected to the film forming nozzle through a conveying component, and the return pipe is communicated with the return port through the conveying component;

wherein the bubble machine defines a height direction and a length direction, the conveying component comprises a first portion and a second portion, the first portion and the second portion are connected to each other along the length direction of the bubble machine, the first portion is disposed below the return port along the height direction of the bubble machine, the first portion is spaced apart from an outer surface of the film forming nozzle, the second portion is disposed below the film forming nozzle along the height direction of the bubble machine, and the second portion is attached to or spaced apart from the outer surface of the film forming nozzle.

* * * * *